US010420435B2

(12) United States Patent
Roselle et al.

(10) Patent No.: US 10,420,435 B2
(45) Date of Patent: Sep. 24, 2019

(54) FABRIC TREATING SYSTEMS AND ACCESSORIES

(71) Applicant: WHIRLPOOL CORPORATION, Benton Harbor, MI (US)

(72) Inventors: Brian Joseph Roselle, Fairfield, OH (US); Corey Michael Bischoff, Cincinnati, OH (US); Christopher Lawrence Smith, Liberty Township, OH (US); Markus Sabisch, Waldems (DE); Oliver von Sartori-Montecroce, Kronberg Hessen (DE); Christof Kleemann, Eschborn (DE); Stefan H. Hollinger, Kronberg im Taunus Hessen (DE); Benjamin Janes Beck, Boston, MA (US); Robert Hans-Joachim Damaschke, Eschborn Hessen (DE); Stephan James Andreas Meschkat, Bad Soden Hessen (DE); Heiko Ullrich, Eppstein (DE); Douglas Arthur Marsden, Marblehead, MA (US)

(73) Assignee: Whirlpool Corporation, Benton Harbor, MI (US)

( * ) Notice: Subject to any disclaimer, the term of this patent is extended or adjusted under 35 U.S.C. 154(b) by 299 days.

(21) Appl. No.: 15/203,284

(22) Filed: Jul. 6, 2016

(65) Prior Publication Data

US 2016/0309937 A1 Oct. 27, 2016

Related U.S. Application Data

(63) Continuation of application No. 12/767,974, filed on Apr. 27, 2010, now Pat. No. 9,410,281.

(Continued)

(51) Int. Cl.

*A47G 25/44* (2006.01)
*A47G 25/32* (2006.01)

(Continued)

(52) U.S. Cl.

CPC ..... *A47G 25/442* (2013.01); *A47G 25/32* (2013.01); *A47G 25/62* (2013.01); *D06F 58/10* (2013.01); *D06F 58/203* (2013.01); *D06F 73/02* (2013.01)

(58) Field of Classification Search

CPC ..... D06F 58/10; D06F 73/02; D06F 58/203; A47G 25/32; A47G 25/62; A47G 25/442

See application file for complete search history.

(56) References Cited

U.S. PATENT DOCUMENTS 1,571,778 A 2/1926 Riffle
1,886,869 A 11/1932 Button (Continued)

FOREIGN PATENT DOCUMENTS

DE 29713157 U1 10/1997
DE 4435672 C2 10/2000

(Continued)

*Primary Examiner* — Clinton T Ostrup
*Assistant Examiner* — Andrew Wayne Sutton
(74) *Attorney, Agent, or Firm* — Price Heneveld LLP

(57) ABSTRACT

A fabric treating system comprises an enclosure comprising a first wall, a second wall, and a fabric receiving space defined by the enclosure. The fabric treating system also comprises a support member positioned proximate to the first wall. The support member is configured to support one of a hanger configured to support a piece of fabric and the piece of fabric within the fabric receiving space. The fabric treating system also comprises a fabric tensioning system positioned at least on the second wall. The fabric tensioning system comprises at least a first fabric grasper configured to (Continued)

be attached to at least a first portion of the piece of fabric to apply tension to the piece of fabric.

14 Claims, 21 Drawing Sheets

Related U.S. Application Data

(60) Provisional application No. 61/217,557, filed on Jun. 1, 2009, provisional application No. 61/174,673, filed on May 1, 2009.

(51) Int. Cl.

| | |
|---|---|
| ***A47G 25/62*** | (2006.01) |
| ***D06F 58/10*** | (2006.01) |
| ***D06F 58/20*** | (2006.01) |
| ***D06F 73/02*** | (2006.01) |

(56) References Cited

U.S. PATENT DOCUMENTS

| | | | |
|---|---|---|---|
| 1,978,123 | A | 10/1934 | Anderson |
| 2,118,786 | A | 5/1938 | Chestnutt |
| 2,195,235 | A | 3/1940 | Brown et al. |
| 2,435,084 | A | 1/1948 | Johnston |
| 2,666,559 | A | 1/1954 | Wexler et al. |
| 3,464,604 | A | 9/1969 | Chezum |
| 3,737,080 | A | 6/1973 | Paris |
| 3,849,815 | A | 11/1974 | Frauendorf |
| 4,566,149 | A | 1/1986 | Fitzwater |
| 4,682,424 | A | 7/1987 | Irving |
| 5,085,358 | A | 2/1992 | Lam |
| 5,253,494 | A | 10/1993 | Frucco et al. |
| 5,305,484 | A | 4/1994 | Fitzpatrick et al. |
| 5,344,054 | A | 9/1994 | Nutter |
| 5,369,892 | A | 12/1994 | Dhaemers |
| 5,511,701 | A | 4/1996 | Lam et al. |
| 5,664,710 | A | 9/1997 | Lam |
| 5,815,961 | A | 10/1998 | Estes et al. |
| 6,189,346 | B1 | 2/2001 | Chen et al. |
| 6,386,392 | B1 | 5/2002 | Argentieri et al. |
| 6,491,840 | B1 | 12/2002 | Frankenbach et al. |
| 6,495,058 | B1 | 12/2002 | Frankenbach et al. |
| 6,628,908 | B2 | 9/2003 | Matsumoto et al. |
| 6,726,186 | B2 | 4/2004 | Gaaloul et al. |
| 6,745,496 | B2 | 6/2004 | Cassella |
| 6,817,497 | B2 | 11/2004 | Grasso et al. |
| 6,840,068 | B2 | 1/2005 | Pasin et al. |
| 6,925,737 | B2 | 8/2005 | Bolduan et al. |
| 6,964,360 | B2 | 11/2005 | Tubman et al. |
| 6,971,549 | B2 | 12/2005 | Leifheit et al. |
| 6,971,589 | B2 | 12/2005 | Incardona et al. |
| 7,043,855 | B2 | 5/2006 | Heilman et al. |
| 7,137,211 | B2 | 11/2006 | Johnson et al. |
| 7,140,121 | B2 | 11/2006 | Casella et al. |
| 7,308,990 | B2 | 12/2007 | Mazooji et al. |
| 7,328,822 | B2 | 2/2008 | Stokes |
| 7,367,137 | B2 | 5/2008 | Jonsson et al. |
| 7,739,891 | B2 | 6/2010 | Luckman et al. |
| 8,407,914 | B2 | 4/2013 | Hollinger et al. |
| 8,484,867 | B2 | 7/2013 | Roselle et al. |
| 9,410,281 | B2 | 8/2016 | Roselle et al. |
| 2004/0163184 | A1 | 8/2004 | Waldron et al. |
| 2005/0023310 | A1 | 2/2005 | Noda |
| 2005/0120757 | A1 | 6/2005 | Jackson |
| 2005/0257440 | A1 | 11/2005 | Seiffert et al. |
| 2005/0262671 | A1 | 12/2005 | Redlin |
| 2007/0020040 | A1 | 1/2007 | Sacks |
| 2007/0108310 | A1 | 5/2007 | Tollens et al. |
| 2008/0000616 | A1 | 1/2008 | Nobile |
| 2008/0256989 | A1 | 10/2008 | Jeong et al. |
| 2009/0038083 | A1 | 2/2009 | Roselle et al. |
| 2009/0126421 | A1 | 5/2009 | Kim et al. |
| 2009/0241268 | A1 | 10/2009 | Yoo et al. |
| 2009/0241269 | A1 | 10/2009 | Yoo et al. |
| 2010/0018262 | A1 | 1/2010 | Beihoff et al. |
| 2010/0071777 | A1 | 3/2010 | Smith et al. |
| 2010/0161143 | A1 | 6/2010 | Smith et al. |
| 2010/0186176 | A1 | 7/2010 | Wright et al. |
| 2010/0242302 | A1 | 9/2010 | Meschkat et al. |
| 2010/0299954 | A1 | 12/2010 | Roselle et al. |

FOREIGN PATENT DOCUMENTS

| | | | |
|---|---|---|---|
| EP | 587173 | A1 | 3/1994 |
| EP | 670135 | A1 | 6/1996 |
| EP | 953669 | A2 | 9/2003 |
| EP | 1528145 | A2 | 5/2005 |
| EP | 1288367 | B1 | 8/2005 |
| GB | 2189522 | A | 10/1987 |
| GB | 2321954 | A | 8/1998 |
| GB | 2377927 | A | 1/2003 |
| GB | 2394271 | A | 4/2004 |
| JP | 10156096 | A | 6/1998 |
| JP | 11057299 | A | 3/1999 |
| KR | 1020090048760 | A | 12/2007 |
| WO | 9949123 | A1 | 9/1999 |
| WO | 0019001 | A1 | 4/2000 |
| WO | 02072940 | A1 | 9/2002 |
| WO | 03074776 | A2 | 9/2003 |
| WO | 2006073885 | A2 | 7/2006 |

FABRIC TREATING SYSTEMS AND ACCESSORIES

CROSS-REFERENCE TO RELATED APPLICATIONS

The present application is a continuation of and claims priority to U.S. patent application Ser. No. 12/767,974, filed on Apr. 27, 2010, entitled "FABRIC TREATING SYSTEMS AND ACCESSORIES," now U.S. Pat. No. 9,410,281, which claims priority to and the benefit of U.S. Provisional Patent Application No. 61/217,557, filed Jun. 1, 2009, entitled "FABRIC TREATING SYSTEM AND ACCESSORIES," and U.S. Provisional Patent Application No. 61/174,673, filed May 1, 2009, entitled "FABRIC TREATING SYSTEM AND ACCESSORIES," the entire disclosures of which are hereby incorporated herein by reference.

FIELD OF THE DISCLOSURE

The present disclosure relates to fabric treating systems and methods for using the same.

The present disclosure also relates to accessories for fabric treating systems and methods for using the same.

BACKGROUND OF THE DISCLOSURE

Fabric treating systems can be used to treat, wash, and/or refresh various fabrics. These fabric treating systems can generally be split into two categories: steam generating systems, and fluid dispensing systems that wet the fabrics with water, chemical solutions, or combinations thereof. Systems of both categories can wet or moisten the fabric with steam or a fluid and then subject the wetted or moistened fabric to heat and/or circulating air to allow the fabric to be dried, thereby treating, washing, and/or refreshing the fabric. There remains a need for fabric treatment systems that are time efficient, consume less space, and are user friendly. As such, it would be advantageous to further develop this technology.

SUMMARY OF THE DISCLOSURE

In one non-limiting embodiment, a fabric treating system comprises an enclosure comprising a first wall, a second wall, and a fabric receiving space defined by the enclosure. The fabric treating system also comprises a support member positioned proximate to the first wall. The support member is configured to support one of a hanger configured to support a piece of fabric and the piece of fabric within the fabric receiving space. The fabric treating system also comprises a fabric tensioning system positioned at least on the second wall. The fabric tensioning system comprises at least a first fabric grasper configured to be attached to at least a first portion of the piece of fabric to apply tension to the piece of fabric.

In another non-limiting embodiment, a fabric treating system comprises an enclosure comprising a first wall, a second wall, and a fabric receiving space defined by the enclosure. The fabric treating system further comprises at least one grasper positioned proximate to the first wall. The at least one grasper is configured to support a piece of fabric within the fabric receiving space. The fabric treating system further comprises a fabric tensioning system positioned proximate to the second wall. The fabric tensioning system comprises at least a second fabric grasper configured to be attached to at least a first portion of the piece of fabric to apply tension to the piece of fabric.

In yet another non-limiting embodiment, a fabric treating system comprises an enclosure comprising a first wall, a second wall, at least a third wall, and a fabric receiving space defined by the enclosure. The fabric treating system further comprises a support member positioned proximate to the first wall. The support member is configured to support a piece of fabric within the fabric receiving space. The fabric treating system further comprises a fabric tensioning system positioned at least on the second wall. The fabric tensioning system comprises a first fabric grasper configured to be attached to a first portion of the piece of fabric to apply tension to the piece of fabric, a second fabric grasper, and a tensioning beam extending from at least one of the first wall, the second wall, and the third wall, wherein a second portion of the piece of fabric is configured to be one of engaged with and at least partially encircled about the tensioning beam, and wherein the second fabric grasper is configured to be attached to a third portion of the piece of fabric to apply tension to the piece of fabric.

In still another non-limiting embodiment, a fabric tensioning apparatus comprises a support beam, a collar comprising a first projection and a second projection, wherein the collar is engaged with the support beam. The fabric tensioning apparatus further comprises a first fabric engaging portion movably attached to the first projection, wherein the first fabric engaging portion is positioned at least partially on a first side of the support beam. The fabric tensioning apparatus further comprises a second fabric engaging portion attached to the second projection, wherein the second fabric engaging portion is positioned at least partially on a second side of the support beam. The fabric tensioning apparatus further comprises a biasing member configured to move at least the first fabric engaging portion relative to the support beam to expand the fabric tensioning apparatus and apply tension to a piece of fabric positioned on the fabric tensioning apparatus.

In still another non-limiting embodiment, a fabric hanger comprises a collar having an aperture defined therein, and an arm configured to support at least one fabric. The fabric hanger further comprises a first hanging member movably engaged with the aperture in the collar, and a separate, second hanging member extending from the collar.

In yet another non-limiting embodiment, a method of tensioning a fabric within a fabric treating system comprises attaching a fabric hanger having a fabric thereon to a support member, attaching a first fabric grasper of the fabric treating system to a portion of the fabric, and tensioning the fabric at least partially intermediate the support member and the first fabric grasper.

In still another non-limiting embodiment, a method of tensioning a fabric comprises providing a fabric tensioning apparatus, positioning a fabric on the fabric tensioning apparatus, and expanding the fabric tensioning apparatus from a first, contracted configuration to a second, expanded configuration to tension the fabric.

In another non-limiting embodiment, a kit for use with a fabric treating system comprises at least one fabric hanger, at least one container of a fabric treatment solution, and at least one tensioner configured to tension a pocket of a garment.

In yet another non-limiting embodiment, an apparatus configured to provide tension to a pocket of a garment comprises a body comprising a first side, a second side, a first end, and a second end. The first side is biasingly attached to the second side proximate to the first end. The first side is also free from attachment with the second side proximate to the second end. At least a portion of the first side and at least a portion of the second side form a biasing member configured to bias the apparatus into a pocket tensioning position.

In still another non-limiting embodiment, a fabric treating system can comprise an enclosure comprising a fabric receiving space defined by the enclosure. A fabric is configured to be positioned within the enclosure. The fabric treating system further comprises a fabric tensioning system positioned on at least one side wall of the enclosure. The fabric tensioning system comprises a first row comprising at least one fabric grasper configured to be engaged with a first side of a fabric, and a second row comprising at least one fabric grasper configured to be engaged with a second side of the fabric. The first row is positioned at a distance away from the second row to maintain an opening in the fabric when the fabric is attached to the at least one fabric grasper of the first row and the at least one fabric grasper of the second row. The fabric treating system further comprises a gas supply positioned at least partially intermediate the first row and the second row. The gas supply is configured to flow a gas into the opening and at least intermediate the first side of the fabric and the second side of the fabric to at least partially dry the fabric.

BRIEF DESCRIPTION OF THE DRAWINGS

The above-mentioned and other features and advantages of the present disclosure, and the manner of attaining them, will become more apparent and the disclosure itself will be better understood by reference to the following description of non-limiting embodiments of the disclosure taken in conjunction with the accompanying drawings, wherein.

DETAILED DESCRIPTION

Figure 1:
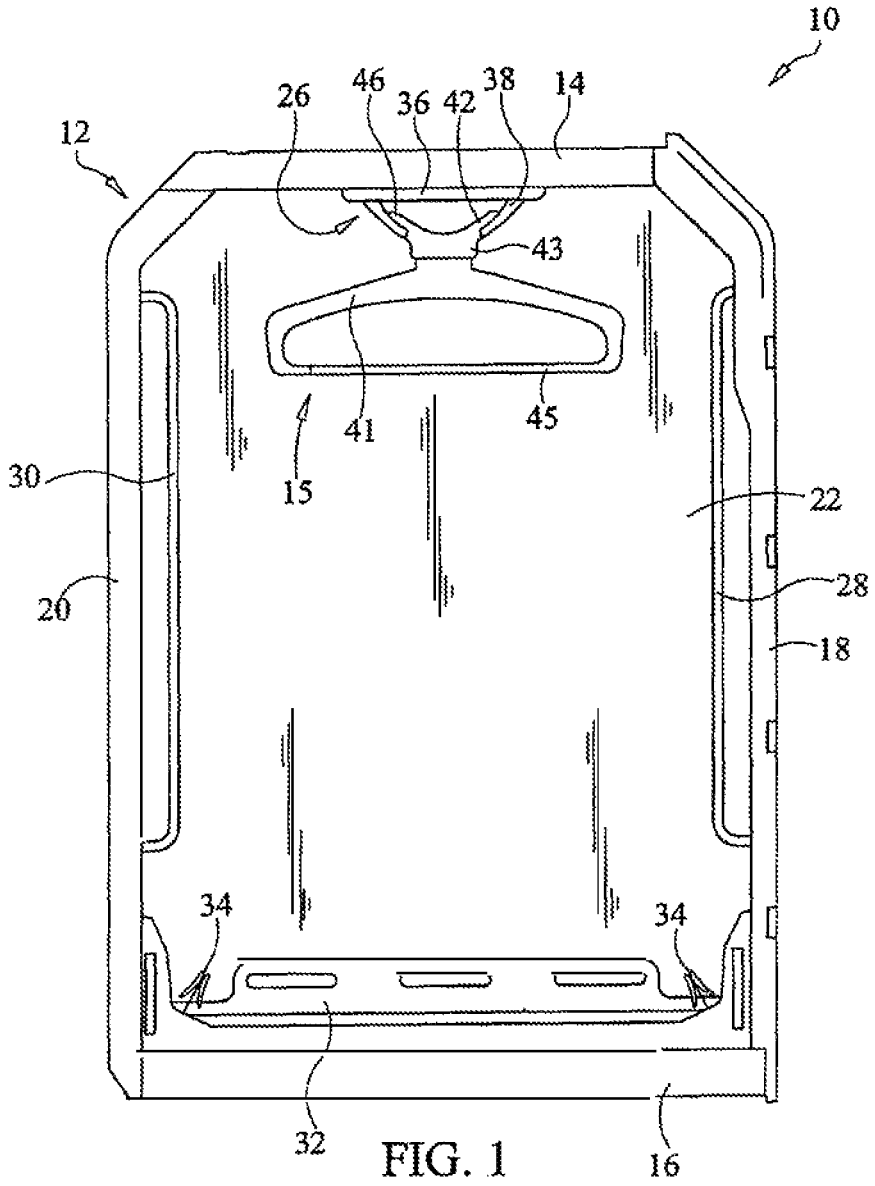
FIG. 1 is a front view of a fabric treating system with a front wall removed for clarity, according to one non-limiting embodiment.

Various non-limiting embodiments of the present disclosure will now be described to provide an overall understanding of the principles of the structure, function, manufacture, and use of the systems, apparatuses, accessories, and methods disclosed herein. One or more examples of these non-limiting embodiments are illustrated in the accompanying drawings. Those of ordinary skill in the art will understand that the systems, apparatuses, accessories, and methods specifically described herein and illustrated in the accompanying drawings are non-limiting example embodiments and that the scope of the various non-limiting embodiments of the present disclosure are defined solely by the claims. The features illustrated or described in connection with one non-limiting embodiment may be combined with the features of other non-limiting embodiments. Such modifications and variations are intended to be included within the scope of the present disclosure.

In one non-limiting embodiment, a fabric treating system can be used to remove wrinkles, remove odors, heat, warm, wet, dry, moisten, and/or refresh fabrics and/or pieces of fabric (hereinafter the terms "fabric" and "piece of fabric" can be referred to interchangeably). In some instances, it may be beneficial to position, orient, and/or configure the fabric to be treated such that it can most effectively receive a wrinkle removing treatment, an odor removing treatment, a heating or drying treatment, a wetting or moistening treatment, and/or a refreshing treatment from the fabric treating system. In such an instance, the fabric can be positioned within the fabric treating system in an expanded, open, partially open, hanging, substantially hanging, and/or substantially flat position, for example, such that a large surface area of the fabric can be treated. In one instance, the fabric can be positioned within the fabric treating system such that it can receive an air flow of warm or hot air at least partially therethrough, or in a space formed between portions of the fabric, for purposes of drying the fabric, for example. In other instances, the fabric can be positioned within the fabric treating system such that it can receive the wetting or moistening treatment substantially uniformly throughout a particular surface area of the fabric. Such a feature can reduce overwetting of the fabric, for example. In addition to expanding the fabric, opening at least a portion of the fabric, and/or substantially flattening the fabric for treatment, various benefits, such as wrinkle removal, for example, can be achieved by tensioning the fabric within and/or external to the fabric treating system. In one non-limiting embodiment, the fabric can be tensioned using weighted fabric graspers or clamps, for example, attached proximate to a lowermost portion or portions of the fabric, when the fabric is in a hanging, a substantially hanging, and/or a suspended orientation. The weighted fabric graspers can tension the fabric owing to the force of gravity acting upon weights of the weighted fabric graspers. In another embodiment, the fabric can also be tensioned through the use of a fabric tensioning apparatus configured to be used external to and/or within the fabric treating system. In still other embodiments, the fabric can be tensioned through the use of a fabric treating system comprising a fabric tensioning system. In one non-limiting embodiment, the fabric tensioning system can be used to properly position the fabric within the fabric treating system such that the fabric can easily be wetted, moistened, dried, heated, and/or refreshed. In any event, the fabric treating system and/or the fabric tensioning system can produce a refreshed, dried, and/or washed fabric with a crisp feel, for example, much like the feel of clothing returned from a dry cleaning process.

Figure 2:
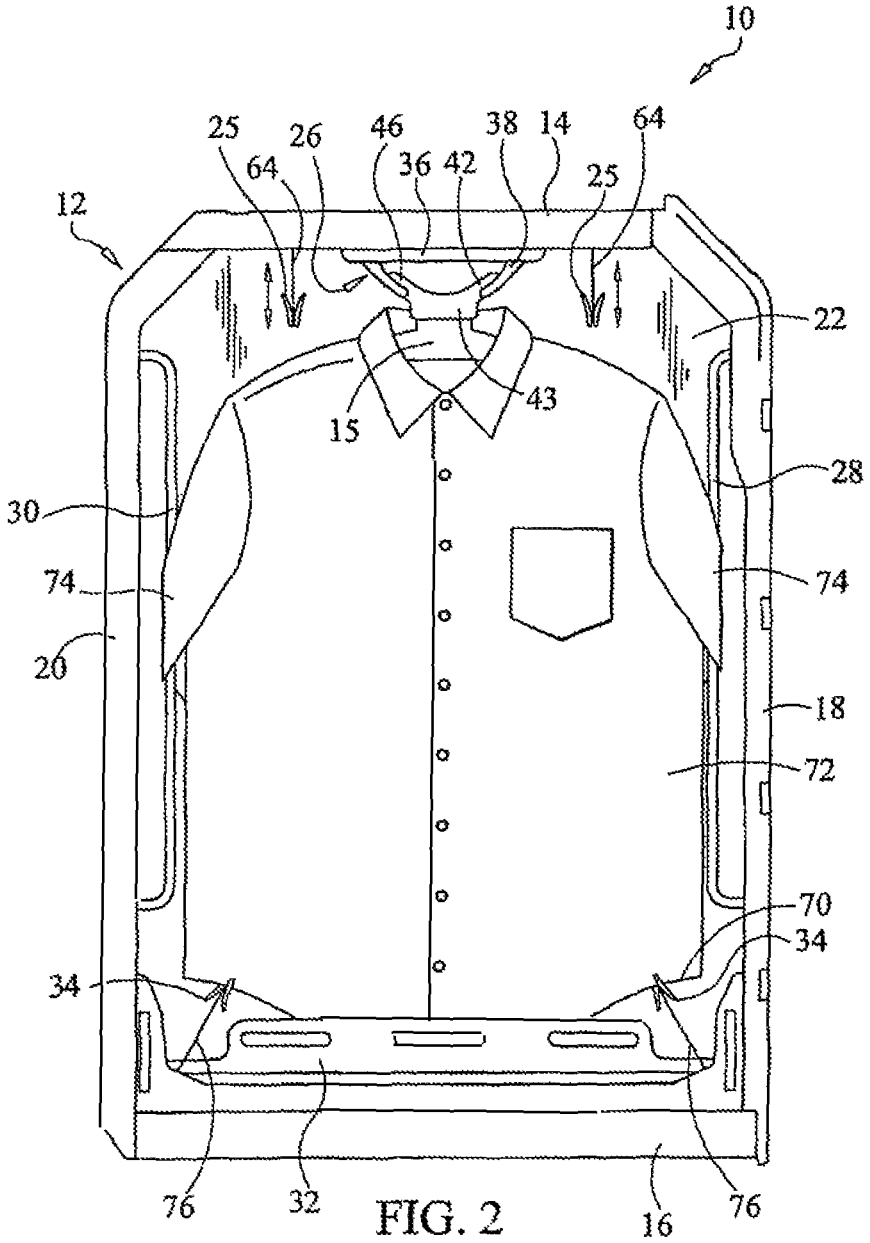
FIG. 2 is a front view of the fabric treating system of FIG. 1 with the front wall removed for clarity and illustrating a fabric within the fabric treating system, according to one non-limiting embodiment.
Figure 24:
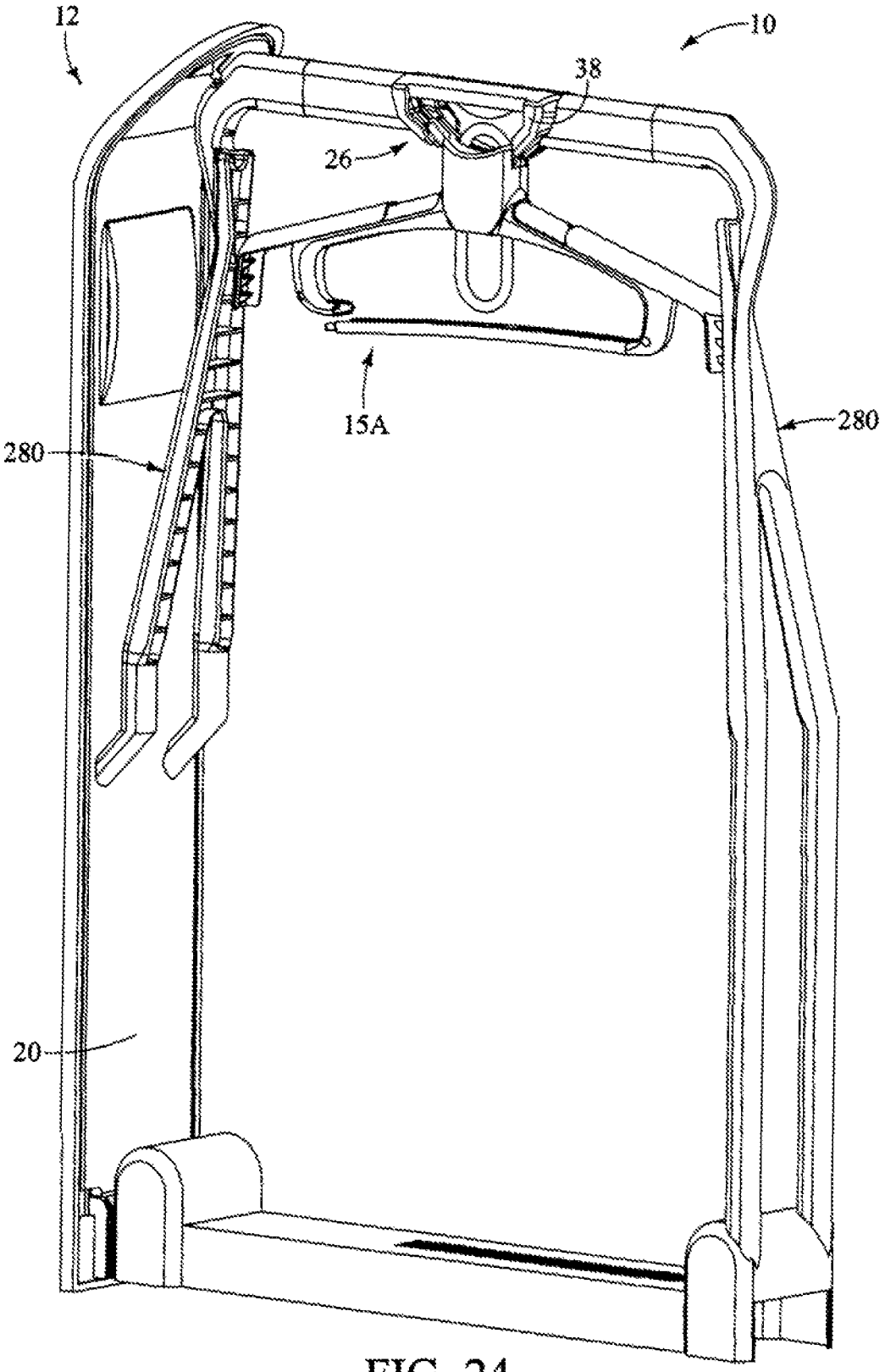
FIG. 24 is a perspective view of a fabric treating system with a front wall, back wall, and one side wall removed for clarity, according to one non-limiting embodiment.

In one non-limiting embodiment, referring to FIGS. 1-7, and 24 a fabric treating system, generally referred to as 10, can comprise an enclosure 12 defined by a first wall 14, a second wall 16, a third wall 18, a fourth wall 20, a rear wall 22, and a front wall 24. FIGS. 1 and 2 illustrate the fabric treating system 10 without the front wall 24 for clarity. FIGS. 3-7 illustrate the fabric treating system 10 without the rear wall 22 for clarity. FIG. 24 illustrates the fabric treating system without first wall 14, second wall 16, third wall 18, and front wall 24 for clarity. Those of skill in the art will recognize that these rear and front walls 22 and 24, respectively, (and third wall 18 in the instance of FIG. 24) would normally be included in the various fabric treating systems to form the enclosure 12. Those of skill in the art will also recognize that the fabric treating system 10 and/or the enclosure 12 can comprise any other suitable configurations, such as more rounded or differently shaped walls, for example. In one non-limiting embodiment, the fabric treating system 10 can comprise an access panel or a door (not illustrated in FIGS. 1-7 and FIG. 24) to enable users to place a fabric, such as a shirt, a blouse, a skirt, a towel, a cloth napkin, a pair of pants, and/or a pair of shorts, for example, into a fabric receiving space defined by the enclosure 12. In one non-limiting embodiment, the enclosure 12 can be at least partially sealed from an external environment surrounding the fabric treating system 10 such that fluids, steams, chemicals, and/or gases used for treating of the fabric can remain wholly or substantially within the enclosure 12 during treatment of the fabric. Further details regarding the fabric treating system 10 and the enclosure 12 are described in further detail below.

In one non-limiting embodiment, referring to FIGS. 1-7, and 24 the fabric treating system 10 can comprise a fabric tensioning system configured to tension a fabric or more than one fabric placed within the fabric receiving space of the enclosure 12. The fabric tensioning system can comprise any suitable tensioning members such as fabric graspers, tensioning bars, clips, resilient members, extendable members, support members, and/or other suitable tensioning members. In any configuration, the fabric tensioning system can allow the fabric treating system 10 to better treat and/or dewrinkle the fabric placed within the fabric receiving space defined by the enclosure 12.

In one non-limiting embodiment, still referring to FIGS. 1-7, and 24 the enclosure 12 may comprise a fabric tensioning system comprising at least one support member 26 configured to receive a fabric hanger 15, a fabric hanger 15', a fabric hanger 15A, a fabric tensioning apparatus 78, and/or a piece of fabric. The fabric treating system can further comprise a first tensioning beam 28, at least a second tensioning beam 30, at least one first fabric grasper 32, and/or at least one second fabric grasper 34. In one non-limiting embodiment, the first and second tensioning beams 28 and 30, the support member 26, and the at least one second fabric grasper 34 can be optional. If the support member 26 is not used in an embodiment, various graspers 25 can be used in its place, for example, to engage the fabric hanger 15 or 15' and/or a portion of a fabric, for example, and optionally apply tension to the fabric. In other non-limiting embodiments, the various graspers 25 can be used in conjunction with the support member 26. In one non-limiting embodiment, a fabric hanger can be attached to an aperture in the first wall 14 or a hook or other attachment member on the first wall 14, for example. In still other embodiments, the fabric hanger 15, 15', or 15A, a regular clothes hanger, and/or the fabric can be attached to the first wall 14 and/or any other suitable wall of the enclosure 12 using any suitable attachment members or methods known to those of skill in the art. In various embodiments, the fabric tensioning system can be used to apply tension to the fabric when the fabric is positioned within the enclosure 12 such that the fabric can be washed, wetted, moistened, refreshed, heated, dried, and/or dewrinkled, for example. In one non-limiting embodiment, owing to the configuration of the various fabric graspers or the various fabric tensioning apparatuses (both discussed in further detail below), the fabric tensioning system can maintain tension on the fabric even if the fabric expands due to wetting, moistening, and/or heating of the fabric. Those of skill in the art will recognize that the fabric tensioning system can be attached to the enclosure 12, formed with the enclosure 12, positioned within the enclosure 12, and/or engaged with the enclosure 12 in any suitable configuration for particular applications, such as treating items of clothing, cloth napkins, towels, or other suitable fabrics, for example, and that the illustrated and described embodiments are merely example embodiments.

In various non-limiting embodiments, still referring to FIGS. 1-7, the support member 26 can be positioned proximate to the first wall 14 and can be configured to retain a fabric, the fabric hanger 15 or 15', and/or the fabric tensioning apparatus 78 and support the fabric in a hanging orientation, a substantially hanging orientation, and/or a suspended orientation. In one non-limiting embodiment, the support member 26 can be movably attached to (see e.g., FIG. 6) or fixedly attached to the first wall 14 or to any other wall or portion of the enclosure 12. The support member 26 can comprise a main body 36 comprising a cradle portion 38 extending therefrom. The cradle portion 38 can be configured to receive portions of a fabric hanger, such as fabric hanger 15, 15', 15A, or the fabric tensioning apparatus 78, for example. In one non-limiting embodiment, the cradle portion 38 can comprise a first side configured to receive a first portion 42 of the fabric hanger 15, 15', ISA, for example, and a second side configured to receive a second portion 46 of the fabric hanger 15, 15', or 15A for example. In various embodiments, other suitable support members configured to support a fabric hanger can be used within the enclosure 12. In one non-limiting embodiment, the support member 26 can be fixedly attached to the first wall 14 by bolts, screws, nails, rivets, adhesives, welds, and/or any other suitable attachment member or method.

Figure 6:
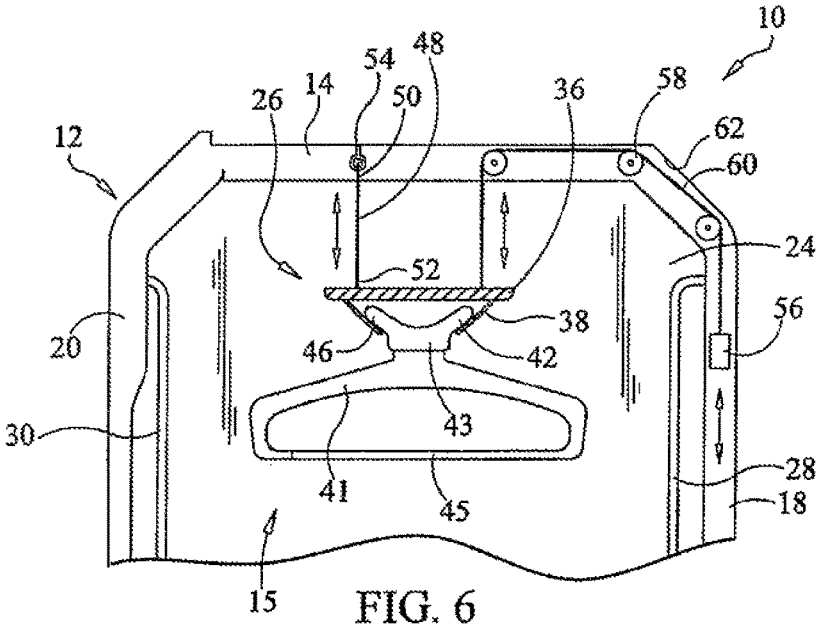
FIG. 6 is a rear partial cross-sectional view of various tensioning systems for a support member of a fabric treating system with a rear wall removed for clarity, according to one non-limiting embodiment.

In other non-limiting embodiments, referring to FIG. 6, the support member 26 can be movably attached to a portion of the first wall 14. This movable attachment can be accomplished through the use of an extendable member and/or a resilient member 48, such as a cord or a band, for example, attached at a first end 50 to a portion of the enclosure 12 and/or the first wall 14 and attached at a second end 52 to the support member 26. In such an embodiment, the resilient member 48 can normally bias the support member 26 toward the first wall 14 to tension the fabric when the fabric is engaged with the first fabric grasper 32 or 32' on the second wall 16, for example. In one non-limiting embodiment, the support member 26 can be pulled away from the first wall 14 by a user to attach the support member 26 to a fabric hanger or to a portion of a fabric. The user can then release the support member 26 to allow the resilient member 48 to bias the support member 26 into a position substantially proximate to the first wall 14. As such, the fabric can be tensioned owing to its attachment to the first fabric grasper 32 or 32' or to the second wall 16, for example. In one non-limiting embodiment, the extendable member can be wound around a spring loaded mechanism, for example, to allow the member to be extended and retracted, for example. In one non-limiting embodiment, the first end 50 of the resilient member 48 can be attached to the enclosure 12 and/or the first wall 14 through the use of an attachment member 54, such as an eye hook or a bolt, for example. The support member 26 can also comprise clips or fabric graspers, for example, for when it must be attached directly to a fabric without a fabric hanger.

In other non-limiting embodiments, still referring to FIG. 6, the support member can be movably engaged with the enclosure 12 and/or the first wall 14 through the use of a weight system and/or a weight and pulley system. The weight system can comprise a weight 56 and a connector 50. The weight and pulley system can comprise the weight 56, at least one optional rotatable pulley 58, and the connector 60. In any embodiment, the connector 60 can be attached to the support member 26 at a first end, extend over the at least one pulley 58, and be attached to the weight 56 at the second end. The weight 56 and the optional at least one pulley 58 can be situated within a channel 62 in the walls of the enclosure 12, for example. The at least one optional pulley 58 can be positioned to rotatably engage the connector 60 and allow the connector 60 to reciprocate within the channel 62 when the support member 26 is moved relative to the first wall 14. In another embodiment, the at least one pulley 58 can be eliminated and the connector 60 can merely reciprocate or slide within the channel 62 when the support member 26 is moved relative to the first wall 14. The connector 60 can be a cord, a string, a band, and/or a cable, for example. As will be understood with reference to FIG. 6, the connector 60 and the weight 56 can normally bias the support member 26 into a position proximate to the first wall 14 to thereby apply tension to the fabric by pulling the fabric hanger and/or a fabric toward the first wall 14. The weight 56 can be normally biased toward the second wall 16 owing to gravitational forces acting upon the weight 56 when the weight 56 is hanging or positioned within the channel 62. The weight 56 can be in the range of about 0.5 lbs to about 10 lbs, alternatively about 1 lb to about 8 lbs, and alternatively about 2 lbs to about 6 lbs, for example. Of course, other suitable weights can also be used.

Further to the above, those of skill in the art will recognize that the biasing systems described above (i.e., the resilient member 48 and the weight system and/or the weight and pulley system) are merely example embodiments of how the support member 26 can be biased towards the first wall 14. A fabric treating system 10 can comprise one or more resilient members 48 and/or one or more weight and pulley systems, for example. The biasing systems are shown as being used together in FIG. 6 merely for illustration. Those of skill in the art will recognize that other mechanical members, such as biasing members, springs, and/or other suitable members can be used to bias the support member 26 toward the first wall 14 either in addition to or in combination with the illustrated example biasing systems. The biasing of the support member 26 can maintain tension on fabrics positioned within the enclosure 12 even if those fabrics expand due to wetting, moistening, and/or heating of the fabrics, for example.

In one non-limiting embodiment, referring to FIG. 2, the first wall 14 can comprise at least one grasper 25 either in addition to or in lieu of the support member 26. In such an embodiment, the at least one grasper 25 can be configured to engage and support a fabric hanger, such as the fabric hanger 15 or 15', for example, within the enclosure 12. In other embodiments, the at least one grasper 25 can be attached to a portion of a fabric to apply tension to and/or expand the fabric for treatment within the enclosure 12. The at least one grasper 25, of course, can also be used to support or maintain the fabric within the enclosure 12 in a hanging orientation or a substantially hanging orientation. In one non-limiting embodiment, the at least one grasper 25 can be attached to or movably attached to the first wall 14, the third wall 18, and/or the fourth wall 20, for example. In an instance where the at least one grasper 25 is movably attached to the first wall 14 (e.g., by an extendable member, a resilient member 64, a weight system, and/or a weight and pulley system), the at least one grasper 25 can be normally biased into a position proximate to the first wall 14, but have the ability to be moved relative to the first wall 14 to engage a fabric and/or a fabric hanger, for example. After engagement with the fabric or the fabric hanger 15 or 15' is achieved, the at least one grasper 25 can tension the fabric owing to it being normally biased toward the first wall 14, for example. The at least one grasper 25 can comprise fabric graspers like the first and second fabric graspers illustrated in FIGS. 1-5 and 7, for example. An embodiment having the at least one grasper 25 can be used in conjunction with any of the first and second graspers positioned on or proximate to the second wall, for example, to tension a piece of fabric, a cloth napkin, or any other suitable fabric or item of clothing. In one non-limiting embodiment, owing to the biasing of the at least one grasper 25, tension can be maintained on fabrics positioned within the enclosure 12 even if those fabrics expand due to wetting, moistening, and/or heating, for example.

In various non-limiting embodiments, any suitable fabric hanger can be used with the fabric treating system 10. In one non-limiting embodiment, referring to FIGS. 1-3, the fabric hanger 15 can comprise a fabric engaging portion 41 configured to be engaged with items of fabric, a projection portion 43, and a cross member 45 configured to support a fabric, such as a pair of pants, for example. The projection portion 43 can comprise a first portion 42 and a second portion 46. The first portion 42 can be engaged with the first side of the cradle portion 38 of the support member 26 and the second portion 46 can be engaged with the second side of the cradle portion 38 of the support member 26. In other non-limiting embodiments, referring to FIGS. 4 and 5, the fabric hanger 15' can be used with the fabric treating system 10. The fabric hanger 15' is discussed in further detail below. In other embodiments, referring to FIG. 7, the fabric tensioning apparatus 78 can be engaged with the cradle portion 38 of the support member 26.

In one non-limiting embodiment, again referring to FIGS. 1-3, the at least one first fabric grasper 32 can be attached to and/or positioned proximate to the second wall 16. The at least one first fabric grasper 32 can be comprised of a clip, a clamp, and/or another suitable fabric engaging member. In one non-limiting embodiment, the at least one first fabric grasper 32 can comprise more than one first fabric grasper positioned along the same line or positioned in rows, for example, such that the first fabric graspers 32 can be engaged with various portions of fabrics positioned within the enclosure 12. As will be understood by those of skill in the art, the at least one first fabric grasper 32 can comprise a first portion and a second portion, wherein the first portion and the second portion can sandwich a portion of fabric therebetween to releasably retain the portion of the fabric to the at least one first fabric grasper 32. The surfaces of the first portion and the second portion of the at least one first fabric grasper 32 that engage the fabric can comprise ridges, a rough surface, and/or rubber portions configured to allow the at least one first fabric grasper 32 to adequately grip and retain, under tension, the portion of the fabric. In one non-limiting embodiment, the at least one first fabric grasper 32 can be fixedly attached to the second wall 16, such that it does not substantially move relative to the second wall 16. In such an embodiment, the support member 26 can move relative to and/or be biased towards the first wall 14 to allow a piece of fabric to be engaged with the support member 26 and the at least one first fabric grasper 32 to tension the fabric. Owing to the biasing of the at least one first fabric grasper 34, tension can be maintained on fabrics positioned within the enclosure 12 even if those fabrics expand due to wetting, moistening, and/or heating, for example.

Figure 3:
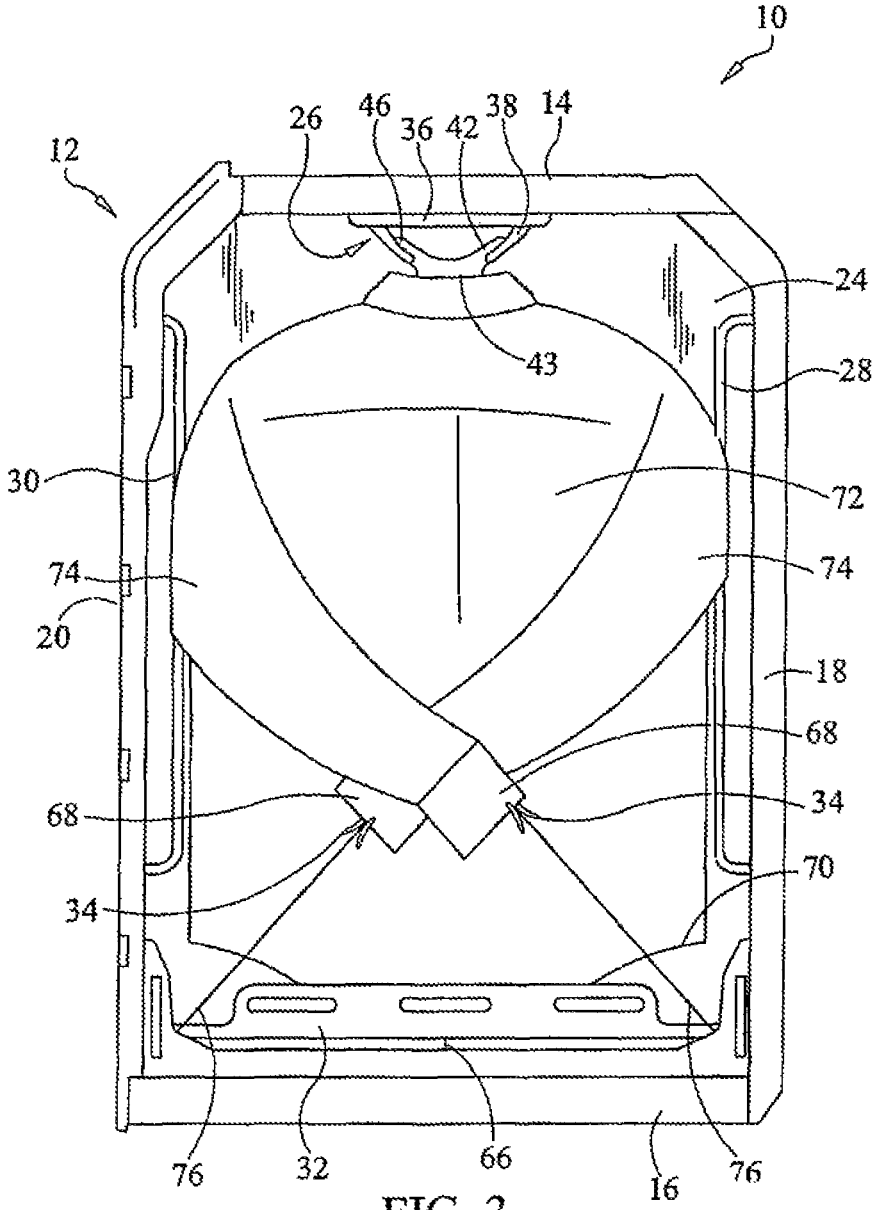
FIG. 3 is rear view of the fabric treating system of FIG. 1 with a rear wall removed for clarity and illustrating a fabric within the fabric treating system, according to one non-limiting embodiment.

In one non-limiting embodiment, referring to FIG. 3, the at least one first fabric grasper 32 can be movably attached to the second wall 16 and/or biased toward the second wall 16 or other wall, but be movable with respect to the second wall 16 or other wall. In such an embodiment, the at least one first fabric grasper 32 can be attached to an end of at least one biasing member 66, such as a retractable elongate member, a resilient member, an extendable member, for example, while the other end of the biasing member 66 can be attached to the enclosure 12, the second wall 16, or other wall. In other embodiments, the at least one first fabric grasper 32 can be attached to an end of the connector 60, while the connector 60 can be operatively engaged with the weight system and/or the weight and pulley system. In any event, the at least one first fabric grasper 32 can be normally biased into a position proximate to or adjacent to the second wall 16, for example. The biasing member 66 for the at least one first fabric grasper 32 can be similar to the biasing systems or members illustrated and described with respect to the support member 26 above. The weight system and/or the weight and pulley system discussed above may need to be slightly modified such that the weight can move via the forces of gravity. In one non-limiting embodiment of the weight system and/or the weight and pulley system, a connector, similar to connector 60 described herein, can extend from the second wall 16 and be positioned over a pin, pivot, and/or a pulley in a channel in the enclosure 12, and then connect to a suspended weight, for example, such that gravity can act upon the weight. Such a modification will be understood by those of skill in the art. In one non-limiting embodiment, the biasing member 66 can be extended from and retracted toward the second wall 16, for example, such that the at least one first fabric grasper 32 can move relative to the second wall 16 or other wall, and be normally biased into a position adjacent to or proximate to the second wall 16, for example. Such biasing of the first fabric grasper 32 can apply tension to the fabric when the at least one first fabric grasper 32 is engaged with a portion of the fabric. In one non-limiting embodiment, the at least one first fabric grasper 32 can work with or can be used in conjunction with the support member 26, the at least one second fabric grasper 34, the at least one optional grasper 25, and/or the tensioning beams 28 and 30, for example, to apply tension to the fabric. In various embodiments, the movable at least first fabric grasper 32 can be used in conjunction with the support member 26 that is fixedly attached to the first wall 14 or movably engaged with the first wall 14, for example.

Figure 4:
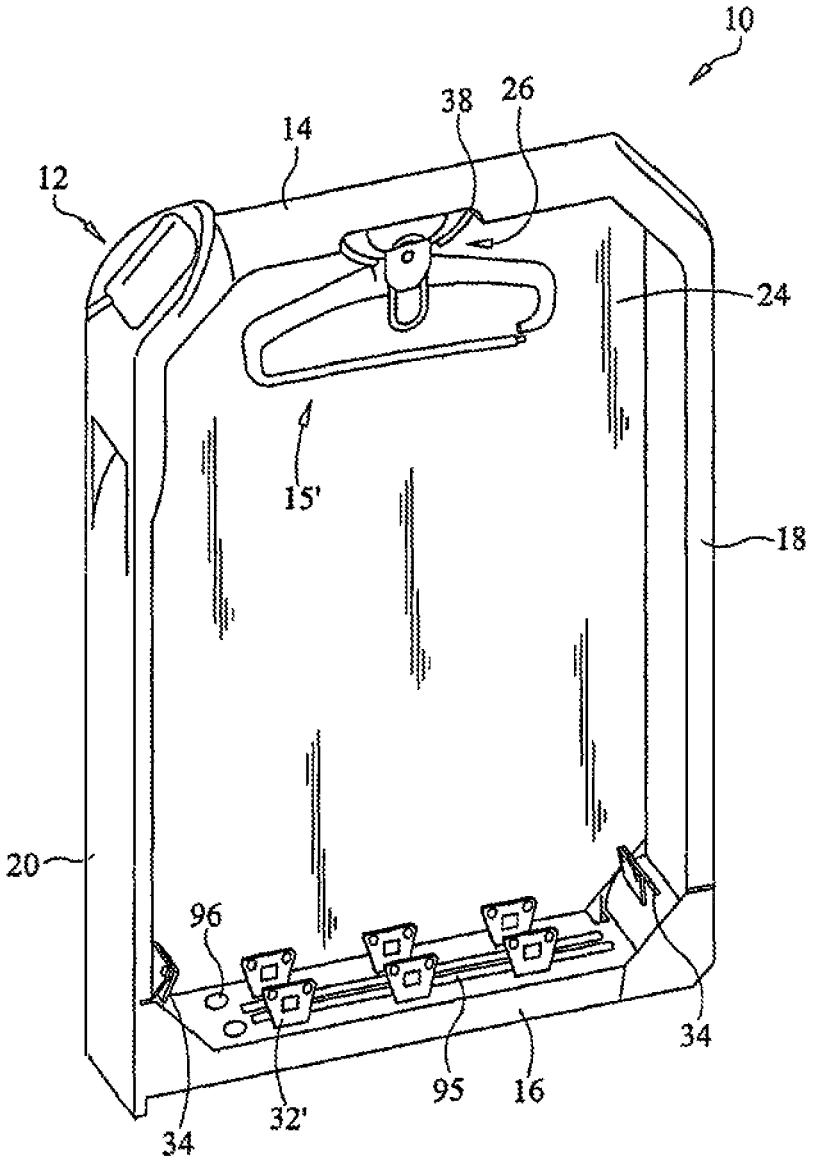
FIG. 4 is a rear perspective view of a fabric treating system with a rear wall removed for clarity, according to one-non-limiting embodiment.
Figure 5:
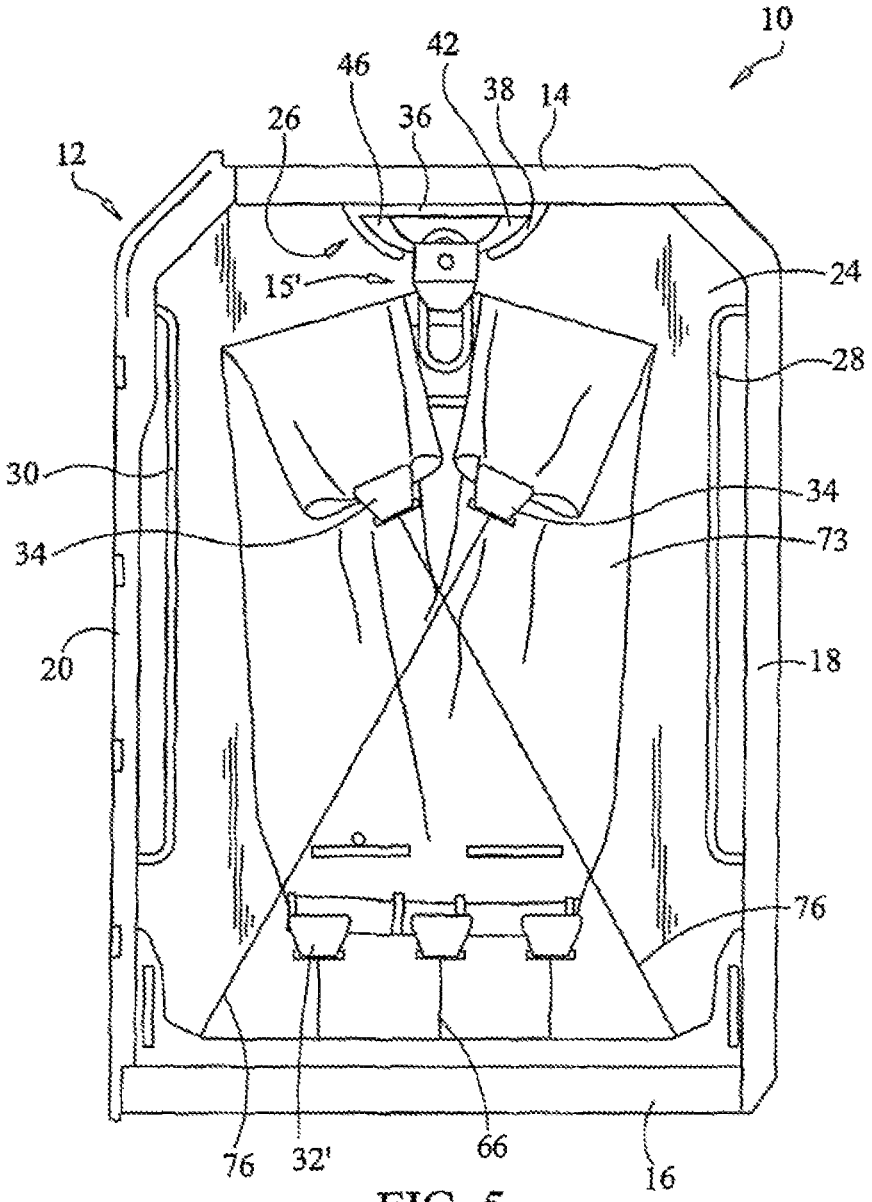
FIG. 5 is a rear view of the fabric treating system of FIG. 4 with the rear wall removed for clarity and illustrating a fabric within the fabric treating system, according to one non-limiting embodiment.
Figure 7:
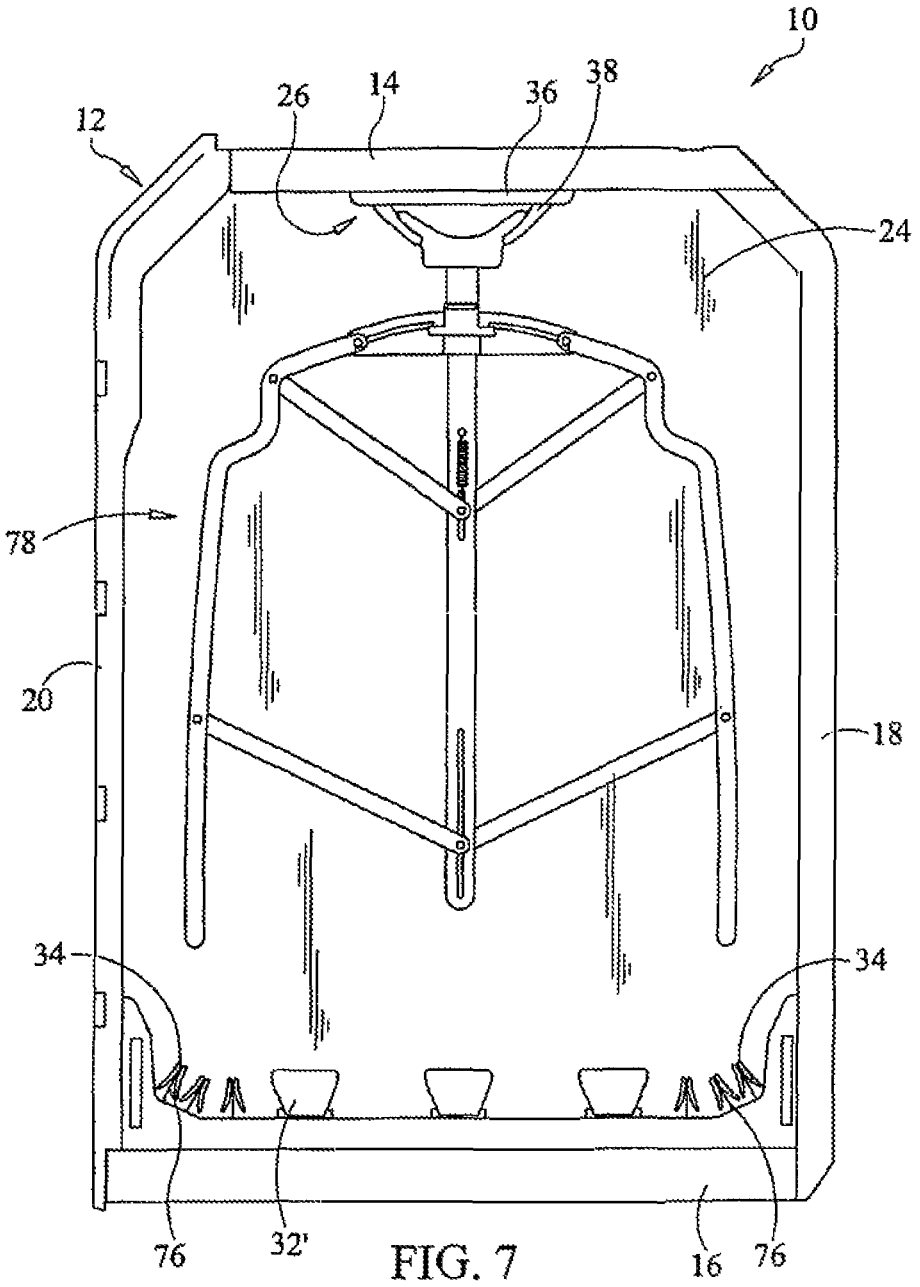
FIG. 7 is a rear view of another fabric treating system with a rear wall removed for clarity, according to one non-limiting embodiment.

In one non-limiting embodiment, referring to FIGS. 4, 5, and 7, one or more first fabric graspers 32' can be configured to engage a fabric within the enclosure 12 to tension the fabric and/or position or orient the fabric within the enclosure 12 for treatment or for drying. In one example embodiment, referring to FIG. 5, the fabric can comprise a pair of slacks or pants 73, for example. In various embodiments, the one or more fabric graspers 32' can be attached to or movably engaged with the second wall 16 or other wall. The one or more first fabric graspers 32' can generally function similar to the at least one first fabric grasper 32 described above. The one or more first fabric graspers 32' can be biased toward the second wall 16 or other wall using the biasing member 66. In the embodiments illustrated in FIGS. 4, 5, and 7, however, more than one first fabric grasper 32' can be used such that multiple portions of a fabric can be engaged by the first fabric graspers 32' to appropriately tension the fabric and/or position or orient the fabric within the enclosure 12 for treatment or for drying. In one non-limiting embodiment, the fabric can be positioned within the enclosure 12 such that it can be dried from the inside out, for example, to promote more efficient drying. As explained with reference to the at least one first fabric grasper 32, the one or more first fabric graspers 32' can be used in conjunction with the support member 26 which can be fixedly attached to the first wall 14 or movably engaged with the first wall 14, but biased towards the first wall. Such an embodiment can allow the fabric to be tensioned between the support member 26 and the one or more first fabric graspers 32' such that the fabric can be treated and/or dewrinkled while within the enclosure 12.

In one non-limiting embodiment, referring to FIG. 4, the one or more first fabric graspers 32' can be provided in a first row of at least one first fabric grasper 32 and a second row of at least one first fabric grasper 32. In such an embodiment, the first row can be spaced a distance (e.g., 1-10 inches) apart from the second row. Such spacing can allow a first bottom portion of a first side of a shirt, for example, to be attached to the first row of the at least one first fabric grasper 32' and can allow a second bottom of a second side of the shirt to be attached to the second row of the at least one first fabric grasper 32'. In such an instance, the first side of the shirt can be held, oriented, and/or positioned within the enclosure 12 at a distance away from the second side of the shirt to allow air to flow through an opening in the shirt formed by the two sides of the shirt to dry the shirt from the inside out, for example. This positioning of the shirt and subsequent air flow into the opening of the shirt can significantly reduce the time required to dry the shirt and/or can improve the treatment or refreshment of the shirt. In one non-limiting embodiment, an air supply 95 can be provided at least partially intermediate the first row and the second row, such that air (e.g., hot air) or other suitable gas from a gas supply or the air supply 95 can be flowed through the opening in the shirt. Such air flow can essentially "inflate" the shirt during drying. The air can flow out of the shirt near a top portion of the shirt, for example. Although the above description uses a shirt as an example of a fabric, those of skill in the art, upon consideration of the present disclosure, will recognize that other fabrics, such as pants, other clothing, and/or other fabric items, for example, can also be dried in a similar fashion owing to the positioning of the first row of the at least one first fabric grasper 32' and the second row of the at least one first fabric grasper 32'. In one non-limiting embodiment, the at least one second fabric grasper 34' can also be used, either alone or in combination with the rows of the one or more first fabric graspers 32', to essentially hold open a portion of a fabric such that air can flow into the space formed intermediate a first side of the fabric and a second side of the fabric to decrease the required drying time of the fabric, for example. By positioning the various fabric graspers in a spaced apart relationship (e.g., in rows), the fabric tensioning system can provide various advantages over the related art, such as reduced energy consumption, faster fabric treatment cycles, and/or more efficient treatment of fabrics, for example. Those of skill in the art will recognize that other suitable positions, orientations, and/or configurations of the various fabric graspers can be used such that fabrics can be optimally positioned and/or oriented within the enclosure 12 to receive a fabric treatment solution (e.g., water, water and fragrance) uniformly or substantially uniformly and/or can be adequately dried.

In an embodiment where more than one fabric, such as two shirts, for example, is being treated and/or dried within the enclosure 12, a bottom portion of the first shirt can be attached to the first row of the at least one first fabric grasper 32' and a bottom portion of the second shirt can be attached to the second row of the at least one second fabric grasper 32', for example. In such an embodiment, a portion of the first shirt can be maintained a distance away from a portion of the second shirt during treatment, washing, wetting, and/or drying, for example, of the first and second shirts. Such positioning can allow a gas, such as air, to flow in between the first shirt and the second shirt to prevent, or at least reduce, the amount of undried fabric on the first shirt and the second shirt.

In one non-limiting embodiment, referring to FIGS. 1-5, and 7, the at least one second fabric grasper 34 can be attached to and/or engaged with at least one of the first wall 14, the second wall 16, the third wall 18, and/or the fourth wall 20. In various embodiments, the at least one second fabric grasper 34 can be positioned proximate to the intersection of the third wall 18 and the second wall 16 and another at least one second fabric grasper 34 can be positioned proximate to the intersection of the fourth wall 20 and the second wall 16, for example. As such, the at least one second fabric grasper 34 can be used to tension and/or position the fabric in any suitable direction and/or orientation within the enclosure 12. Of course, in other embodiments, any suitable fabric graspers can be used to tension and/or position the fabric in any suitable direction and/or orientation within the enclosure 12. In one non-limiting embodiment, the various fabric graspers of the present disclosure can be used to tension the fabric in a direction other than the direction of gravitational pull on the various fabric graspers and the fabric. In one non-limiting embodiment, referring to FIG. 7, a plurality of second fabric graspers 34 can be positioned proximate to the intersection of the third wall 18 and the second wall 16 and the fourth wall 20 and the second wall 16. In other embodiments, the at least one second fabric grasper 34 can be positioned on each wall of the enclosure 12 or on at least two walls of the enclosure 12, for example. In one instance, the second fabric grasper 34 can be comprised of a clip, a clamp, a grasping device, and/or any other suitable fabric engaging member configured to be engaged with a fabric. In use, the at least one second fabric grasper 34 can be engaged with various portions of a fabric, such as cuff portions 68, bottom portions 70, other portions of a shirt 72, or portions of a pair of pants 73, for example, to apply tension to the shirt 72 or the pair of pants 73. The second fabric grasper 34 can, of course, comprise suitable gripping portions or surfaces such that the second fabric grasper 34 can be releasably retained to a portion of a fabric during use. Those of ordinary skill in the art will recognize that the at least one second fabric grasper 34 can be used to engage any suitable portion of a fabric and can be used in conjunction with the tensioning beams 28 and 30, the at least one first fabric grasper 32 or 32', the at least one grasper 25, and/or the support member 26, for example.

In one non-limiting embodiment, the at least one second fabric grasper 34 can be movably engaged with the second wall 16, the third wall 18, and/or the fourth wall 20. Of course, the at least one second fabric grasper 34 could also be positioned on the first wall 14, for example. In one non-limiting embodiment, referring to FIGS. 2, 3, and 5, the at least one second fabric grasper 34 can be attached to an end of a biasing member 76, while the other end of the biasing member 76 can be engaged with a portion of the enclosure 12 and/or to one of its various walls. In one non-limiting embodiment, the movable engagement of the second fabric grasper 34 with the various walls of the enclosure 12 can allow the at least one second fabric grasper 34 to be extended towards the fabric and be releasably attached to the fabric. Once attached to the fabric and released, the biasing member 76 can cause the at least one second fabric gasper 34 to be retracted toward and/or biased toward the second wall 16, for example, to tension the fabric.

In one non-limiting embodiment, the biasing member 76 can be a resilient member, and extendable member, and/or a retractable member configured to be biased towards the various walls, such as the second wall 16, for example, of the enclosure 12. In various embodiments, the biasing member 76 can be similar in structure and/or function as the biasing members or biasing systems discussed above. In any event, owing to the biasing of the at least one second fabric grasper 34, tension can be maintained on fabrics positioned within the enclosure 12 even if those fabrics expand due to wetting, moistening, and/or heating, for example.

In one non-limiting embodiment, referring to FIGS. 1-3 and 5, the at least one first fabric grasper 32 or 32' and the at least one second fabric grasper 34 can be used in conjunction with or independent of the support member 26 and/or the first and second tensioning beams 28 and 30.

In an embodiment where the various fabric graspers are used in conjunction with the first and second tensioning beams 28 and 30, an item of clothing, such as the shirt 72, for example, or other fabrics can be tensioned. In one non-limiting embodiment, the first tensioning beam 28 can extend from, be formed with, or be attached to the third wall 18 and, similarly, the second tensioning beam 30 can extend from, be formed with, or be attached to the fourth wall 20. In other embodiments, other tensioning beams with other configurations, lengths, diameters, and/or shapes can be positioned at other suitable locations within the enclosure 12 or on other suitable walls of the enclosure 12. In one non-limiting embodiment, the tensioning beams 28 and 30 can be attached to the various walls of the enclosure 12 or other portions of the enclosure 12 using bolts, screws, rivets, adhesives, nails, welding, and/or any other suitable attachment method.

In one non-limiting embodiment, referring to FIGS. 2 and 3, portions of a fabric, such as the sleeves 74 of the shirt 72, for example, can be engaged with or can at least partially encircle the first and second tensioning beams 28 and 30. Then, the second fabric graspers 34 can be engaged with the cuff portions 68 of the shirt 72 to apply tension to the shill 72 and/or to the sleeves 74 of the shirt 72. In such an embodiment, the shirt 72 can also be tensioned by the support member 26 and/or the at least one first fabric grasper 32 or 32' to tension all or most of the shirt 72. In other embodiments, although not illustrated, portions of other fabric items, such as towels, for example, can at least partially encircle or engage the first and second tensioning beams 28 and 30, while other portions of the fabrics items can be engaged with the at least one second fabric grasper 34 or 34', for example. Those of skill in the art will recognize other uses and placements for other various tensioning beams within the enclosure 10.

In one non-limiting embodiment, tensioning beams (not illustrated), either in addition to or in lieu of the tensioning beams 28 and 30, can be angled toward the first wall 14 and a portion of the tensioning beams can be attached to and/or formed with the first wall 14. In such an embodiment, a first tensioning beam can be attached at a first end to the second wall 16 and attached at a second end to the first wall 14. Similarly, a second tensioning beam can be attached at a first end to the third wall 18 and attached at a second end to the first wall 14. Both the first tensioning beam and the second tensioning beam can be angled toward an area on the first wall 14 proximate to the support member 24 and/or toward a central location on the first wall 14. In one non-limiting embodiment, the first tensioning beam can be angled between about 10 to about 80 degrees with respect to the second wall 16 toward the central location on the first wall 14, alternatively between about 30 to about 60 degrees, alternatively between about 40 to about 50 degrees, and alternatively about 45 degrees, for example. The second tensioning beam can be angled relative to the third wall 18 toward the support member 24 and/or the central location on the first wall 14 in the same or a similar fashion as the first tensioning beam. Such angling of the tensioning beams relative to the second wall 16 and/or the third wall 18 can allow the fabric treating system 10 to apply a composition, such as water, for example, to at least most of a back portion of the shirt 72, as in this embodiment, the sleeves 74 can be positioned and/or tensioned in a more vertical orientation having less overlap with the back portion of the shirt 72. In such an embodiment, the second fabric graspers 34 may not need to be crossed, as illustrated in FIG. 3, but instead can extend and engage the cuff portions 68 of the shirt 72 on their respective sides of the enclosure 12 to tension the sleeves 74 in a substantially vertical position, for example.

In one non-limiting embodiment referring to FIG. 24, portions of fabric can engage with or partially encircle "Y" shaped frame 280 in order to tension the fabric.

In one non-limiting embodiment, FIG. 7 illustrates an example fabric tensioning apparatus 78 that can be used within the enclosure 12 or external to the enclosure 12 of the fabric treating system 10. The fabric tensioning apparatus 78 can be engaged with the cradle portion 38 of the support member 26, similar to the fabric hanger 15 or 15' described above, to releasably retain the fabric tensioning apparatus 78 in a hanging, a substantially hanging, and/or a suspended orientation within the fabric receiving space defined by the enclosure 12. The fabric tensioning system 78 of FIG. 7 is illustrated in a second or an expanded configuration and without a fabric thereon for clarity. The example fabric tensioning apparatus 78 is described in greater detail below. Of course, the fabric tensioning apparatus 78 can be used in conjunction with the at least one first fabric grasper 32 or 32', the at least one second fabric grasper 34, the at least one grasper 25, and/or other features of the fabric treating system 10 described herein.

In one non-limiting embodiment, although not illustrated, the fabric treating system 10 can comprise a fabric tensioning system comprising a support member, such as the support member 26, for example, and at least one weighted fabric attachment member configured to be attached to a portion of the fabric. The weighted fabric attachment member may be independent of the enclosure 12 but positionable on the portion of the fabric by a user either prior to positioning the fabric within the enclosure 12 or after positioning the fabric within the enclosure 12. The weighted fabric attachment member can comprise a clip comprising a weight or a weighted portion, for example. The weight or weighted portion can comprise any suitable materials, such as water, metals, and/or powders, for example. The weighted fabric attachment member via the weight or weighted portion can apply a tensile force to a hanging fabric when the weighted fabric attachment member is attached proximate to a bottom portion (in a hanging orientation or other suitable orientation) of the piece of fabric. The weight or weighted portion can apply a tensile force to the fabric owing to the gravitational forces applied to it. In one non-limiting embodiment, the weighted fabric attachment member can be used in conjunction with the fabric tensioning apparatus 78 when it is used within or outside of the enclosure 12. In other embodiments, the weighted fabric attachment member can be used in conjunction with the fabric hanger 15 or 15' and/or any other suitable hanger when those hangers are used within or external to the fabric treating system 10.

Figure 8:
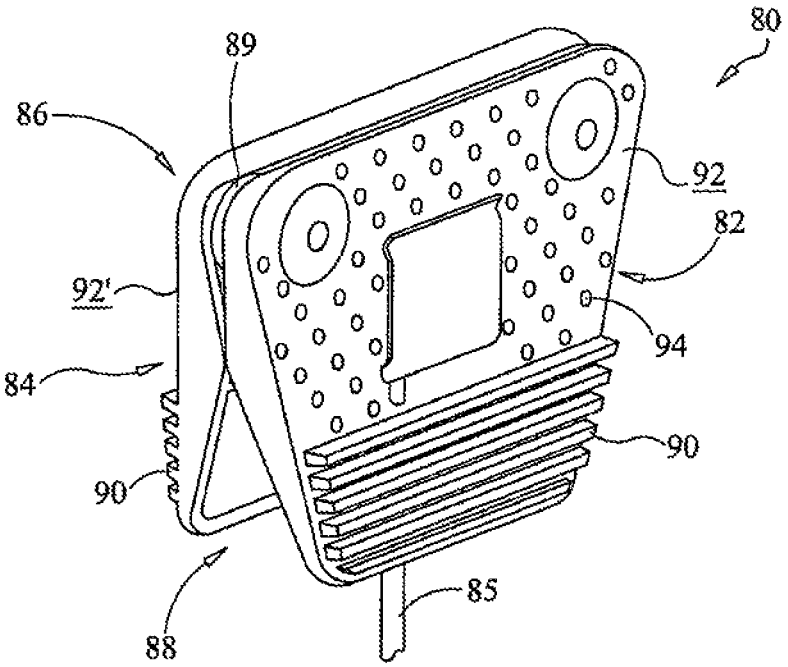
FIG. 8 is a perspective view of a fabric grasper configured to be used in conjunction with a fabric treating system, according to one non-limiting embodiment.
Figure 9:
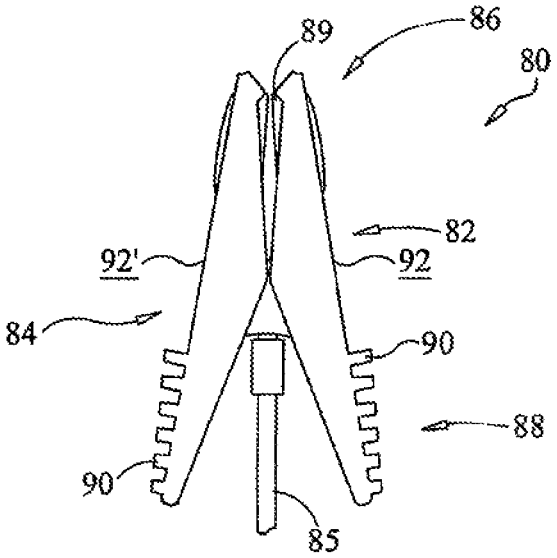
FIG. 9 is a side view of the fabric grasper of FIG. 8 in according to one non-limiting embodiment.

FIGS. 8 and 9 illustrate one example grasper 80 that can be used as the first fabric grasper 32', the at least one second fabric grasper 34, the at least one grasper 25, and/or other graspers provided with the fabric treating system 10. The grasper 80 can comprise a first side 82 and a second side 84 that opposes or substantially opposes the first side 82. As illustrated, the example grasper 80 can comprise a grasping portion 86 and an actuation portion 88. In one non-limiting embodiment, the grasping portion 86 can be configured to be engaged with a fabric and can comprise gripping members 89 comprised of a rubber material or other high coefficient of friction materials that are configured to adequately grip and hold the fabric when engaged therewith. In another embodiment, the gripping members 89 can also comprise a rough surface, a ribbed surface, and/or a surface with ridges, for example to aid the gripping member 89 in retaining the fabric therebetween. The actuation portion 88 can be compressed together to move the first and second sides 82 and 84 of the grasping portion 86 away from each other to open the grasping portion 86 and allow the grasping portion 86 to be engaged with the fabric. Once the fabric is positioned within the grasping portion 86, pressure being applied to the actuation portion 88 can be released to allow the grasping portion 86 to close and engage the fabric. A biasing member (not illustrated), such as a spring, for example, can be positioned between the first side 82 and the second side 84 and can be attached to and/or apply a force to the first side 82 and the second side 84 to normally bias the gripping portion 86 into a position where the gripping members 89 are in contact with and/or sandwich fabric therebetween. In one non-limiting embodiment, the grasper 80 can be configured such that it will not damage the biasing member when the grasper 80 is retracted against one of the various walls of the enclosure 12. In one non-limiting embodiment, the grasper 80 can be attached to a resilient, an extendable, and/or a retractable member, for example, such that it can be movable with respect to a wall of the enclosure 12 and be normally biased toward the wall of the enclosure 12 to enable the grasper 80 to apply tension to a fabric.

Further to the above, in one non-limiting embodiment, the grasper 80 can comprise other features configured to dissipate heat from the grasper 80 during or after a cycle of the fabric treating system 10. In one non-limiting embodiment, the grasper 80 can comprise ribs 90 on outer surfaces 92 and 92' of the first side 82 and the second side 84, respectively. These ribs 90 can be located primarily on the actuation portion 88 where a user's hand or fingers would contact the actuation portion 88 to open the grasping portion 86 of the grasper 80. In one non-limiting embodiment, air surrounding the outer surfaces of the ribs can cool the ribs 90 faster than the surfaces 92 and 92', for example. In one non-limiting embodiment the ribs may be designed such that the height of the ribs above the surfaces 92 and 92' are greater than about 0.3 mm and the spacing between the ribs or projections are preferably less than about 10 mm, to help keep a user's fingers from sliding down between the ribs touching the surfaces 92 and 92'. In addition, the ribs or projections themselves are also preferably less than about 10 mm wide.

Further, in one non-limiting embodiment, the first and second sides 82 and 84 of the grasper 80 can comprise apertures 94 therein. These apertures 94 can again aid in dissipating heat from the grasper 80 during and after a cycle of the fabric treating system 10, such that the grasper 80 can be handled by a user of the fabric treating system 10. Those of skill in the art will recognize that any other suitable method of heat dissipation for the grasper 80 can be used and is within the scope of the present disclosure.

In one non-limiting embodiment, the grasper (not illustrated) can be configured to grasp and/or be releasably engaged with a fabric that is thin and/or delicate, for example. In such an instance, the grasper can be provided with gripping members that have a large surface area, relative to the surface area of the gripping members 89. This large surface area on the gripping members can be used to distribute the force applied by the gripping members and/or the grasping portion of the grasper to the thin and/or delicate fabric over the large surface area of the gripping members, thereby preventing, or at least minimizing, any marks left on the thin and/or delicate fabric by the gripping members where the gripping members engaged the fabric. In another embodiment, each gripping member can comprise a portion comprising a rubber material, a compressible material, a deformable material, and/or a foam material to again prevent, or at least minimize, marks being left on the thin and/or delicate fabric where the grasping members engaged the fabric. Those of skill in the art will recognize that other suitable devices can be used to reduce marks left on the fabric by the gripping members, such as by placing a pad, a sheet, and/or a film intermediate the gripping members and the fabric, for example.

In one non-limiting embodiment, the grasper can comprise a grasping force adjustment member (not illustrated). The grasping force adjustment member can be used to adjust the amount of grasping force, or compressive force that is applied by a particular grasper to a fabric. In one non-limiting embodiment, the grasping force adjustment member can be adjusted such that a greater grasping force can be applied by the grasping members for a thicker or a less delicate fabric, while a lesser grasping force can be applied by the grasping members for a thinner or a more delicate fabric. The grasping force adjustment member can, for example, increase or decrease the pressure being applied by a spring or other biasing member to allow the grasping members to engage various fabrics with different compressive forces. In one non-limiting embodiment, by using the grasping force adjustment member to configure each grasper for engaging various fabrics, marks left on the fabric caused by the gripping portions of the grasper can be eliminated and/or at least reduced.

In one non-limiting embodiment, referring to FIG. 4, the fabric treating system 10 can comprise at least one visual indicia 96, such as color coding, diagrams, and/or other suitable visual indicia, on or proximate to the various components of the fabric treating system 10. The visual indicia 96 can indicate to a user how to use the various components of the fabric treating system 10 and/or how the various components work together. In one non-limiting embodiment, the various graspers can be color-coded. For example, the first fabric grasper 32 or 32' can be blue and the second fabric grasper 34 can be orange. As such, in view of various instructions provided with the fabric treating system 10, a user will understand that the first fabric grasper 32 or 32' should be attached to the bottom portion of a shirt or a waistband of a pair of slacks, for example, and the second fabric grasper 34 can be used as an auxiliary grasper to attach to a cuff of a sleeve of a shirt, for example, and/or any other portion of a fabric that needs additional tensioning and/or support. In other embodiments, diagrams of how to use the various components can be positioned on external surfaces of the enclosure 12 and/or on internal surfaces of the enclosure 12 and proximate to each fabric grasper, for example. In one non-limiting embodiment, the diagrams can comprise a picture of a cuff of a sleeve of a shirt, a picture of a bottom portion of a shirt, and/or a picture of a waist band of a pair of slacks, for example, to instruct users how to attach the component to the fabric being treated. Those of skill in the art will recognize that any other suitable visual indicia that can help users understand how to use the various components of the fabric treating system 10 can be provided.

In one non-limiting embodiment, referring to FIGS. 10-13, a perspective view of a fabric treating system 110 can comprise an enclosure 112 forming at least one opening and an extractable portion 114, wherein the extractable portion 114 is illustrated in a partially opened position. In such an embodiment, the extractable portion 114 is illustrated as a front portion which can be horizontally, or substantially horizontally, pulled out of or actuated out of the opening formed in the enclosure 112 via any suitable mechanical, electric, and/or manual members. Non-limiting examples of the mechanical members used to extract the extractable portion 114 can comprise spring loaded member, chain driven members, and/or levered members, for example. In other embodiments, the extractable portion 114 can be positioned and configured to at least partially exit the enclosure 112 in an upwards direction, a vertical direction, or a substantially vertical direction, for example, as opposed to a lateral or a horizontal direction.

In one non-limiting embodiment, the extractable portion 114 can comprise one or more sliding members, such as a wheel and/or a glide with or without roller bearings, for example, which can be configured to slide along a rail provided with the enclosure 112. In one non-limiting embodiment, the enclosure 112 can be a non-collapsing member comprising a pair of side walls, a top, a front wall, a rear wall, and/or a base wall, wherein at least a portion of one of the top, front wall, and/or rear wall can be formed from a face 116 of the extractable portion 114. The face 116 can comprise an outer surface 118. In one non-limiting embodiment, the face 116 can at least partially seal the opening of the enclosure 112 when the face 116 is in a closed position. When the face 116 does not fully seal the opening of the enclosure 112, a gap between the face 116 and the enclosure 112 can perform the function of an inlet and/or outlet vent in a venting system of the fabric treating system 110. In another embodiment, the face 116 can fully seal the enclosure 112 when in the closed position. In yet another embodiment, the outer surface 118 of the face 116 can form a flush closure with the enclosure 112 and/or a seal on the enclosure 112. The extractable portion 114 is illustrated with an optional handle 140 for accessing the extractable portion 114 from the exterior of the enclosure 112.

Figure 10:
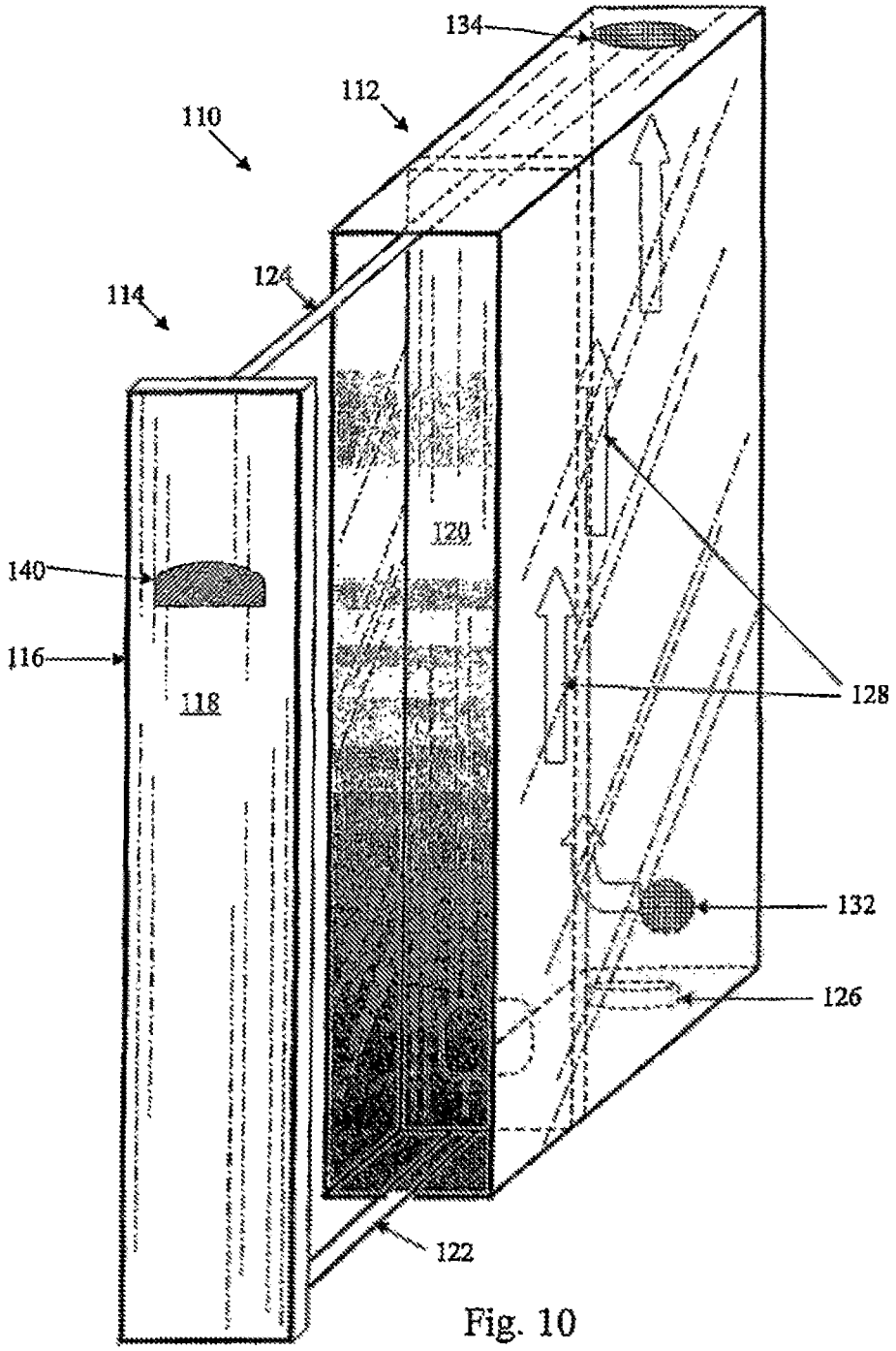
FIG. 10 is a perspective view of a fabric treating system with an extractable drawer is in a partially opened position, according to one non-limiting embodiment.

In one non-limiting embodiment, referring to FIG. 10, the extractable portion 114 is illustrated with an optional rear face 120 and an optional base 122. In this embodiment, the rear face 120 can be contained within the enclosure 112 such that the extractable portion 114 does not usually fully detach from the fabric treating system 110. In another embodiment, the extractable portion 114 can be fully detachable from the fabric treating system 110. In one non-limiting embodiment, a supporting portion 124 can extend from the face 116 to the optional rear face 120. In such an embodiment, the supporting portion 124 can be used to hang fabrics and/or fabric hangers thereon. One advantage obtained by providing the rear face 120 that fits within the interior space of the enclosure 112 is that a user has limited exposure to the condition of the interior side walls of the enclosure 112 or any tubes or wires provided in the enclosure 112. It is believed that upon repeated use, the interior side walls can collect residue or buildup from a fabric treatment composition being sprayed or misted within the fabric treating system 110 and evaporated from the fabrics being treated therein.

Further to the above, in one non-limiting embodiment, referring again to FIG. 10, the fabric treating system 110 can comprise a heating element 126 and an air flow path 128. When the extractable portion 114 is in a closed position, the air flow path 128 can direct at least a portion of the air to and/or through a fabric receiving space of the enclosure 112. The heating element 126 can be positioned within the enclosure 112 at any location that allows the heating element 126 to transfer heat, either through convection, conduction, and/or radiation, for example, to the interior of the enclosure 112, particularly to the fabric receiving space of the enclosure 112, more particularly to any fabrics contained within the fabric receiving space of the enclosure 112. Suitable heating elements can comprise heating wire or coil, an infrared lamp, a microwave heating element, and combinations thereof, for example. In one non-limiting embodiment, the heating element 126 can be provided to be flush with the lower portion of the enclosure 112 such that it does not obstruct the closing of the extractable portion 114 when the rear face 120 is moved towards the back of the enclosure 112.

In one non-limiting embodiment, still referring to FIG. 10, the air flow path 128 can be facilitated by a venting system comprising an inflow vent 132 and an outflow vent 134, for example. The inflow vent 132 can be positioned below the outflow vent 134. This is believed to allow for natural convection and movement of the heated air to escape without the need for active air flow. In another embodiment, the inflow vent 132 can be positioned above the outflow vent 134. Air flowing from the inflow vent 132 to the outflow vent 134 can be by natural convection or via forced draft. In the case of forced draft, a fan or other forced air movement means can be inserted in the air flow path 128. In one non-limiting embodiment, the fan can be located near the inflow vent 132 or the outflow vent 134 in order to avoid interference with the extractable portion 114.

Figure 11:
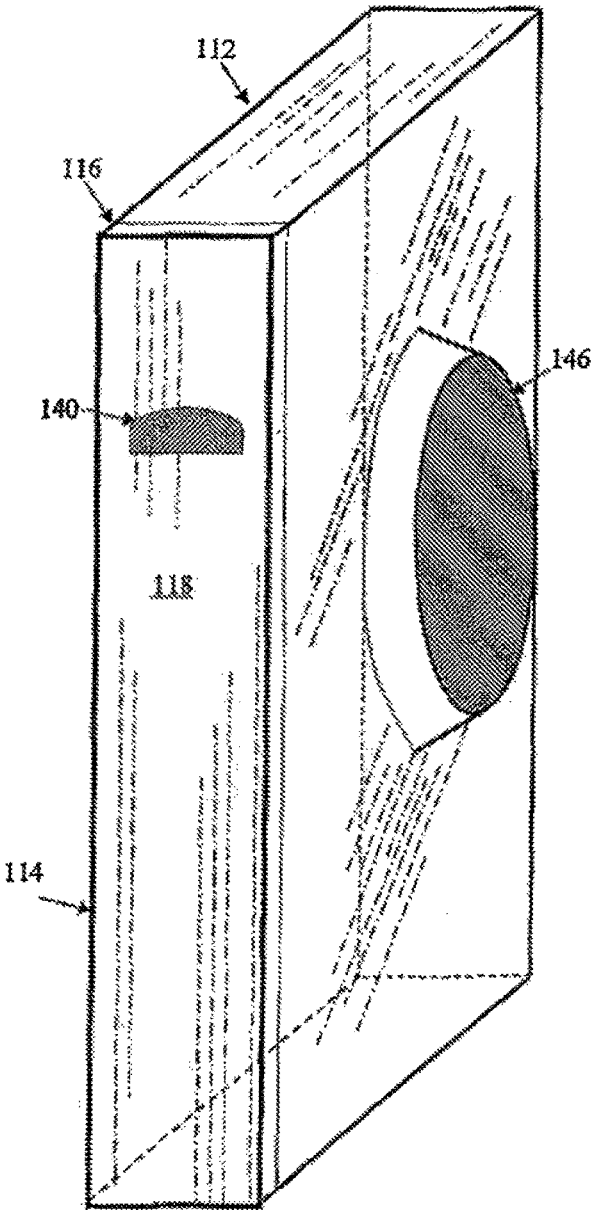
FIG. 11 is a perspective view of another fabric treating system according to one non-limiting embodiment.
Figure 12:
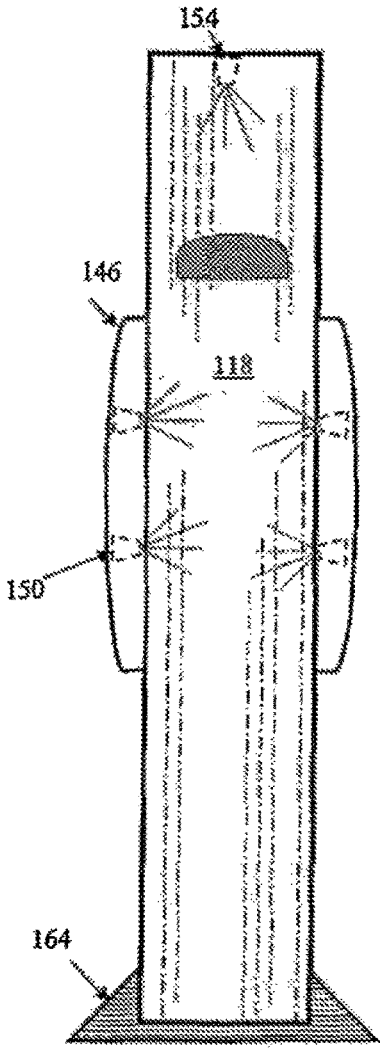
FIG. 12 is a front view of another fabric treating system according to one non-limiting embodiment.

FIGS. 11 and 12 illustrate views of the fabric treating system 110 in accordance with other embodiments of the present disclosure, wherein the extractable portion 114 is in a closed position. In one non-limiting embodiment, the fabric treating system 110 can comprise one or more side protrusions 146 extending beyond the frontal planar periphery of the face 116. The side protrusions 146 can be provided in a variety of suitable shapes which allow for a slight increase in the distance between dispensing heads and a suspended fabric. In one non-limiting embodiment, the side protrusions 146 can have any prism shape, such as a rectangle, square, or other polygon, or an arcoidal shape, such as a circle, oval, or ellipse, for example.

In one non-limiting embodiment, referring to FIG. 12, the fabric treating system 110 of the present disclosure can comprise a plurality of dispensing heads 150 positioned on the side walls of the enclosure 112 and/or within the side protrusions 146. In such an embodiment, the dispensing heads 150 can comprise one or more sprayer heads and/or one or more ultrasonic nebulizers. The dispensing heads 150 may be used when a flow rate of a fabric treatment composition is desired to be high, for example, greater than about 2 grams of fluid per minute per nozzle. In one non-limiting embodiment, where the fabric treating system 110 comprises one or more of the side protrusions 146, one or more of the dispensing heads 150 can be positioned on the interior of the side protrusions 146 to increase the lateral distance between the dispensing heads 150 and any fabric contained within the fabric receiving space of the enclosure 112. Those of skill in the art will understand that by providing two or more sets of dispensing heads 150, the fabric can be wetted in a faster, more efficient manner. Further, by increasing the horizontal distance between the dispensing heads 150 and the fabric, the dispensed fluid can have more space to disperse and cover more area on the fabric. In one non-limiting embodiment, FIG. 12 illustrates an optional dispensing head 154 positioned at the top of the enclosure 112, and oriented to spray downwards onto a fabric positioned within the fabric treating system 110. Additional dispensing heads can be placed throughout the interior of the fabric treating system 110, such as on the interior portion of the face 116, on a rear face, and/or a bottom face, for example. The dispensing heads 150 can be situated for maximum fabric coverage and for avoiding spray interference by any of the components of the fabric treating system 110.

In one non-limiting embodiment, where the dispensing heads 150 comprise one or more sprayer heads, the sprayer heads can comprise one or more spray nozzles, such as 2, 3, 4, or 6 spray nozzles, for example. Multiple spray nozzles in the sprayer head can provide effective distribution of a benefit composition directly to a fabric or a garment to be treated to minimize application time. Dispensing of a benefit composition can be achieved using any suitable device such as a hydraulic nozzle, sonic or ultrasonic nebulizers, pressure swirl atomizers, high pressure fog nozzle, and/or a combination thereof, to deliver target particle sizes and coverage patterns. Non-limiting examples of suitable nozzles can comprise nozzles commercially available from Spray Systems, Inc., such as Spray Systems, Inc. of Ponoma, Calif., under the Model 40 Nos.: 850, 1050, 1250, 1450 and 1650. Another non-limiting example of a sprayer head or nozzle is a pressure swirl atomizing nozzle made by Seaquist Dispensing of Gary, 111, under the Model No. DU3813.

In one non-limiting embodiment, the dispensing heads 150 and/or 154 can act as a fluid atomizing nozzle, using either a pressurized spray, or a dual fluid nozzle using air assist, for example. Pressurized spray nozzles can have the advantage of not requiring high pressure air to assist atomization of the treatment fluid. Special nozzle designs can be employed as well, for example utilizing a high voltage power supply to act as an electrostatic spray nozzle.

Suitable sprayer heads can be solitary nozzles or a compound nozzle containing more than one nozzle. In one non-limiting embodiment, there can be four sprayer heads housed within a side protrusion 146 on each side of the fabric treating system 110 with each sprayer head comprising four individual spray nozzles that are mounted in a dome shaped housing, for example. Nozzle design typically can be chosen in conjunction with the enclosure's design. If no side protrusion 146 or a thin side protrusion is desired, a nozzle providing a wider angle of spray can typically be used to get broad coverage where there is a short distance to the fabrics or garments to be treated. A wider side protrusion 146 distance can facilitate a nozzle with a slightly narrower angle of spray to achieve acceptable coverage.

In one non-limiting embodiment, nozzle flow rates can vary depending on the number of nozzles utilized. In general, the nozzle flow rate times the number of nozzles times the spraytime can produce the desired amount of benefit composition to be applied to the fabric. In one non-limiting embodiment, the total spray time can be less than about 114 seconds, alternatively less than about 112 seconds, and alternatively less than about 10 seconds, for example. In one non-limiting embodiment, where there are a total of eight compound nozzles of four individual nozzles each, the spray time utilizing a small pump and pressure swirl nozzles, can be about 2 seconds with a total benefit composition sprayed of up to about 10 grams, alternatively up to about 25 grams, alternatively up to about 50 grams, and alternatively up to about 112 grams, for example. Those of skill in the art will understand that by increasing the number of spray nozzles in the fabric treating system, the total device flow rate can be increased. For example, one spray nozzle can provide an increase of about 1 gram per second. In addition to the sprayer heads, the fabric treating system 110 can also comprise one or more ultrasonic nebulizers, for example.

Optionally, the benefit composition may be heated prior to being sprayed by the spray nozzles. Pre-heating the benefit composition prior to being sprayed by the spray nozzles may be accomplished by any heating element, such as a heating wire or coil, an infrared lamp, microwave heating, radiative heating, and/or any other suitable heating apparatus or method, for example.

FIG. 12 is a front view of a fabric treating system 110 in accordance with at least one non-limiting embodiment of the present disclosure. The fabric treating system 110 of FIG. 12 is similar to the fabric treating system of FIG. 11, except that this fabric treating system 110 can comprise a base stand 164.

Figure 13:
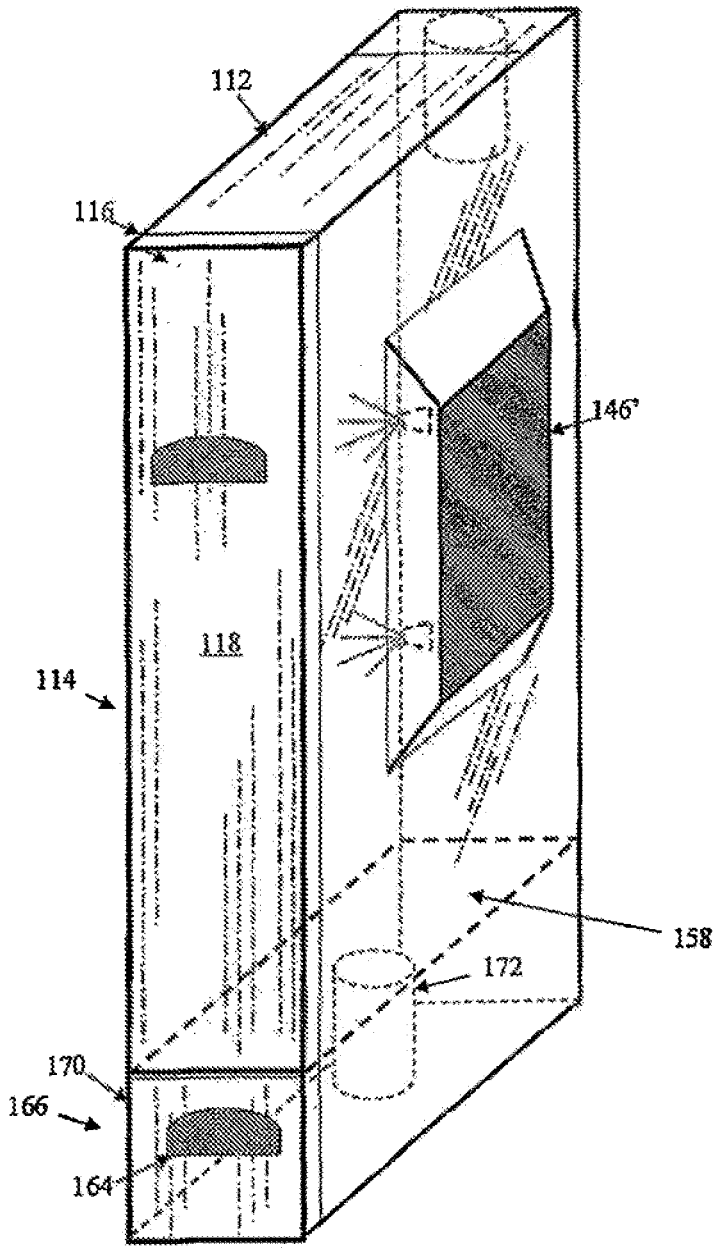
FIG. 13 is a perspective view of another fabric treating system according to one non-limiting embodiment.
Figure 14:
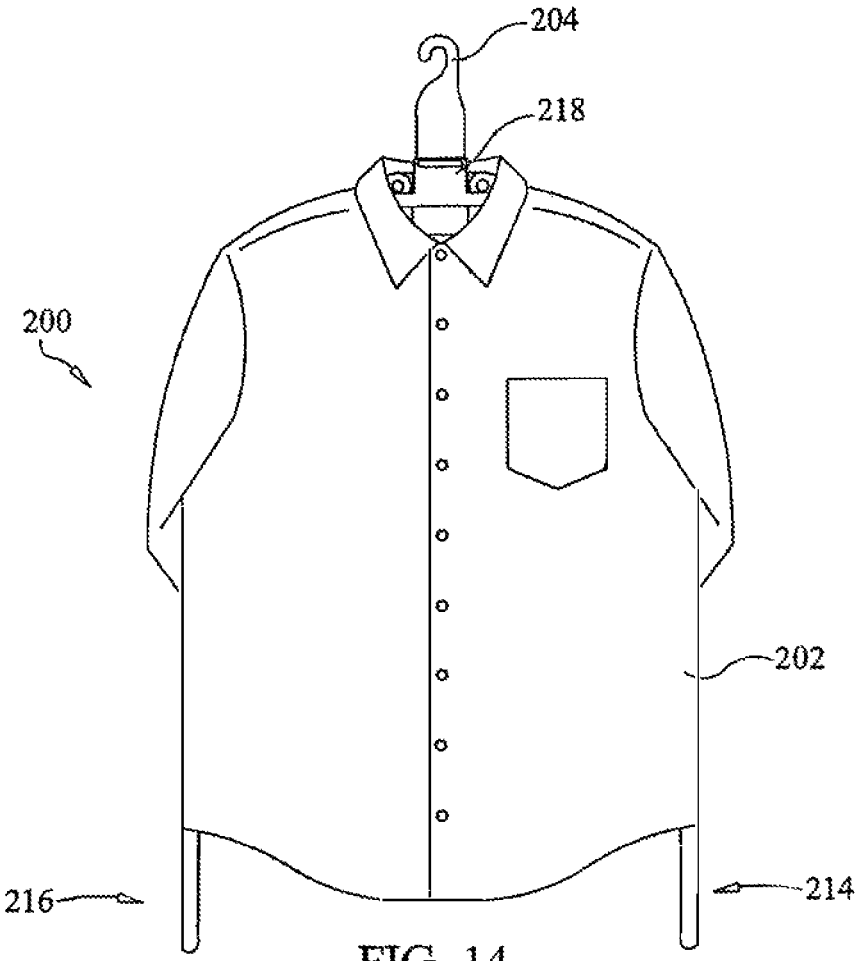
FIG. 14 is a front view of a fabric tensioning apparatus with a piece of fabric positioned thereon, according to one non-limiting embodiment.

FIG. 13 illustrates a perspective view of a fabric treating system 110 in accordance with at least one non-limiting embodiment of the present disclosure. The fabric treating system 110 comprises a side protrusion 146' having a rectangular or quadrilateral shape such as a square or rectangular prism shape, for example. The fabric treating system 110 can further comprise a second extractable portion 166 comprising a second face 170. The second extractable portion 166 can be configured to receive a reservoir 172 containing a benefit composition therein and can comprise a handle 164, similar to handle 140 above. In one non-limiting embodiment, the extractable portion 114 can comprise a base 158. In one non-limiting embodiment, the base 158 can comprise an aperture to allow exposure to any heating element provided below the extractable portion 114 and/or a channel to facilitate heated air flow either by natural or forced draft convection.

In one non-limiting embodiment, referring to FIG. 13, the fabric treating system 110 of the present disclosure can contain a source of any suitable fabric treatment composition, for example. In one non-limiting embodiment, the source of fabric treatment composition can be positioned within or contained within the reservoir 172 positioned in the second extractable portion 166. In other embodiments, the reservoir 172 can also be positioned in the upper portion 174 of the enclosure 112. Where the reservoir 172 is positioned in the second extractable portion 166, the reservoir 172 can be accessed by pulling out the second extractable portion 166. Where the reservoir 172 is positioned in the upper portion 174 of the enclosure 112, an opening in the enclosure 112 can be provided to allow access to the reservoir 172. The reservoir 172 can be operably connected to at least one dispensing head provided within the fabric treating system 110, wherein at least one spray head is oriented to dispense the fabric treatment composition towards the fabric receiving space of the enclosure 112 and onto the fabric. In one non-limiting embodiment, the reservoir 172 can be a refillable or a replaceable reservoir, for example.

In one non-limiting embodiment, the source of the fabric treatment composition can comprise a container of a fabric treatment composition operably connected to a plurality of dispensing heads provided within the fabric treating system 110, a detached spray member, a fluid transport member operably connected to a building piping system, and/or a combination thereof, for example. Suitable detached spray members can comprise hand spray products, such as FEBREZE® fabric spray, DOWNY® Wrinkle Release sprayers, and/or any other commercially available spray apparatus, such as starch sprays or bottled perfume sprays, and/or aerosol can products, such as FEBREZE® Air Effects, for example. Suitable detached spray member sizes can comprise about 12 oz. containers and about 27 oz. containers, for example. The detached spray member can be a bottle that can be provided separate from the fabric treating system 110 or can be removably attached to the fabric treating system 110, such as in a bottle stand, for example. In one non-limiting embodiment, where a user desires just to wet the fabric with water, the source of the fabric treatment composition can be provided from another device, such as a laundry machine or a faucet in the home, for example.

In various embodiments, referring to FIGS. 10-13, the handle 140 or 164 can be a button a user could push to release and/or at least partially eject the extractable portion 114 from the enclosure 112. This button can be a single activation trigger that pulls the portion into the closed position and turns on the fabric treating system for operation. The extractable portion 114 can also be spring loaded such that it will automatically extend away from the enclosure 112 when actuated. By automatically exposing a supporting member of the fabric treating system 110, there is no need for the user to touch or contact any interior contents or side walls of the fabric treating system. Additional features and advantages of the various non-limiting embodiments of the fabric treating systems discussed herein are disclosed in greater detail in U.S. Patent Application Ser. No. 61/076,321, filed on Jun. 27, 2008, entitled "FABRIC REFRESHING CABINET DEVICE," which is hereby incorporated by reference in its entirety.

Any suitable liquid and/or fluid fabric treatment composition can be used as a fabric treatment composition without deviating from the present disclosure. Suitable fabric treatment compositions can comprise any liquid or fluid composition which reduces and/or removes wrinkles, malodors, and/or delivers any other desirable fabric treatment benefits. Additional suitable fabric treatment compositions can comprise perfumes and fragrances that can impart desirable odors upon the fabrics and/or into the ambient air where the fabric treating system is stored. Water, including purified water, tap water and the like are also suitable fabric treatment compositions. Although the present fabric treating systems are used for refreshing a fabric or a garment, such as by reducing malodors and/or wrinkles, for example, it is possible to use a composition which can be stain repellent and/or assist in the removal of stains, soil, discolorations, and/or other undesirable affects from the wearing and use of the fabrics.

In one non-limiting embodiment, the fabric treatment composition can comprise water and optionally a member selected from the group consisting of surfactants, perfumes, preservatives, bleaches, auxiliary cleaning agents, shrinkage reducing compositions, organic solvents and mixtures thereof. The fabric treatment composition can comprise both volatile and non-volatile ingredients. Suitable organic solvents can comprise glycol ethers, specifically, methoxy propoxy propanol, ethoxy propoxy propanol, propoxy propoxy propanol, butoxy propoxy propanol, butoxy propanol, ethanol, isopropanol, wrinkle removing agents, in-wear anti-wrinkling agents, semi-durable press agents, odor absorbing agents, and/or volatile silicones and/or mixtures thereof. Fabric shrinkage reducing compositions that are suitable for use can be selected from the group consisting of ethylene glycol, all isomers of propanediol, butanediol, pentanediol, hexanediol and/or mixtures thereof. In one non-limiting embodiment, the fabric shrinkage reducing compositions can be selected from the group consisting of neopentyl glycol, polyethylene glycol, 1,2-propanediol, 1,3-butanediol, 1-octanol and/or mixtures thereof. Suitable surfactants can comprise a nonionic surfactant, such as an ethoxylated alcohol or ethoxylated alkyl phenol, and is present at up to about 2%, by weight, of the fabric treatment composition. Auxiliary cleaning agents can comprise cyclodextrins and dewrinkling agents, such as silicone containing compounds, for example. Especially anti-wrinkling agents can comprise volatile silicones, some of which can be purchased from the Dow Coming Corporation. One such volatile silicone is D5 cyclomethicone decamethyl cyclopenta siloxane. Typical fabric treatment compositions herein can comprise at least about 80%, by weight, water, alternatively at least about 90% water, and alternatively at least about 95% water, for example. Non-limiting examples of suitable fabric treatment compositions are provided in U.S. Pat. No. 6,726,186 to Gaaloul et al.

Another suitable fabric treatment composition can be the polymer composition having specified pH for improved dispensing and improved stability of wrinkle reducing composition disclosed in U.S. Pat. No. 6,491,840 and the aqueous wrinkle control composition disclosed in U.S. Pat. No. 6,495,058 both references to Frankenbach et al.

In yet another embodiment, the fabric treatment composition disclosed in U.S. Patent Publication No. 2009/0038083 published on Feb. 12, 2009 in the name of Roselle et al. can be used. For example, one suitable fabric treatment composition can comprise a water soluble quaternary ammonium surfactant. Typically the minimum levels of the water soluble quaternary agent included in the composition are at least about 0.01%, alternatively at least about 0.05%, and alternatively at least about 0.1%, while typical maximum levels of water soluble quaternary agent are up to about 20%, alternatively less than about 10%, and alternatively less than about 3% and generally in the range of about 0.2% to about 1.0%, a substantially water insoluble oil component or oil mix, wherein the oil components may have a clogP of >1. Typically the minimum levels of the oil component included in the composition are at least about 0.001%, alternatively at least about 0.005%, alternatively at least about 0.01% and typically maximum levels of oil components are up to about 5.0%, and alternatively less than about 3%, and generally in the range of about 0.05% to about 1%; optional ingredients as disclosed in U.S. Patent Publication No. 2009/0038083 referenced above in this paragraph, and balance of water.

In one non-limiting embodiment, a fabric tensioning apparatus is configured to tension a fabric, such as a shirt, a skirt, a jacket, a blazer, a blouse, other items of clothing, a towel, a table cloth, a cloth napkin, and any/or other suitable fabrics and/or materials that can benefit from tensioning and/or expansion. Referring to FIGS. 14-18, an example fabric tensioning apparatus 200 is illustrated. As illustrated, a fabric, such as a shirt 202, for example, is positioned on thefabric tensioning apparatus 200 such that the shirt 202 can be tensioned to eliminate or alleviate wrinkles, for example. The fabric tensioning apparatus 200 can be used before, during, and/or after washing or treating the fabric in a conventional washing device or in the fabric treating systems described herein. The fabric tensioning apparatus 200 can also be used on fabrics that have just been washed or that have previously been washed, but that require additional tensioning for treatment and/or dewrinkling. In one non-limiting embodiment, the fabric tensioning apparatus 200 can comprise a hanger 204 suitable for suspending the fabric tensioning apparatus 200 from a support such as a horizontal bar or rod in a closet, for example (see e.g., FIGS. 14-16). In other embodiments, a hanger 204' can be configured to be suspended from a support member or a cradle of a support member within a fabric treating system or an enclosure, for example (see e.g., FIGS. 17 and 18). Of course, those of ordinary skill in the art will recognize that other suitable hangers, hanging members, and/or suspension members are within the scope of the present disclosure and can be used to hang or suspend the fabric treating apparatus 200 in various suitable locations.

In one non-limiting embodiment, still referring to FIGS. 14-18, the fabric tensioning apparatus 200 can comprise a support beam 206. The support beam 206 can comprise an end configured to be attached to or integrally formed with the hanger 204 or 204' or to any other suitable hangers. A collar 208 can be configured to be fixedly attached to and/or movably or slidably engaged with the support beam 206 such that, in some embodiments, the collar 208 can move relative to the support beam 206 (see e.g., FIGS. 14, 16, and 18). In one non-limiting embodiment, referring to FIGS. 15 and 16, the collar 208 can be locked in a position on the support beam 206 using a locking mechanism to prevent, or at least inhibit, movement of the collar 208 relative to the support beam 206. The locking mechanism can comprise a threaded thumbwheel 207 configured to engage and/or frictionally engage a rack 209 or other suitable member. In other embodiments, a suitable ratcheting lever, a camming lever, a quick release pin/detent arrangement, or a spring loaded button/detent arrangement, for example, can be used as the locking mechanism. A plurality of detents (not illustrated) can be formed in the support beam 206 such that the quick release pin and/or the spring loaded button can engage a detent when the collar 208 is in a suitable position relative to the support beam 206. Those of skill in the art will recognize that the quick release pin and/or the spring loaded button can be normally biased toward the support beam 206 such that they can engage the detents and remain within the detents as desired. Of course, any other suitable locking mechanism known to those of skill in the art can be used and is within the scope of the present disclosure.

In one non-limiting embodiment, the collar 208 can comprise a first projection 210 and a second projection 212. The collar 208 can be positioned on the support beam 206 at a location on the collar 208 at least partially intermediate the first projection 210 and the second projection 212. The fabric tensioning apparatus 200 can also comprise a first fabric engaging portion 214 attached to, or movably attached to, the first projection 210 and positioned at least partially on a first side of the support beam 206 and a second fabric engaging portion 216 attached to, or movably attached to, the second projection 212 and positioned at least partially on a second side of the support beam 206. In other embodiments, both the first fabric engaging portion 214 and the second fabric engaging portion 216 can be fixedly attached to the collar 208 or can be movably engaged with the collar 208, for example.

In one non-limiting embodiment, the first projection 210 can define an elongate slot 211 therein and/or the second projection 212 of the collar 208 can define an elongate slot 213 therein. An end portion 215 of the first fabric engaging portion 214 and/or a pin extending therefrom can engage the elongate slot 211 and can be movable within the elongate slot 211 defined in the first projection 210 and/or an end portion 217 of the second fabric engaging portion 216 and/or a pin extending therefrom can engage the elongate slot 213 and can be movable within the elongate slot 213 formed in the second projection 212. As such, when a release mechanism on the collar 208 is in a disengaged position (i.e., not contacting the first and second fabric engaging portions 214 and 216), the end portions 215 and 217 and/or the pins extending therefrom can move within the elongate slots 211 and 213 in a direction relative to the support beam 206 or a direction away from the support beam 206 owing to forces applied to the first and second fabric engaging portions 214 and 216 by a biasing member and at least one cross member. Those of skill in the art will recognize that at least one of the elongate slots 211 or 213 can be eliminated within the scope of the present disclosure and the fabric tensioning apparatus 200 can still function to tension and/or expand a fabric positioned thereon.

In one non-limiting embodiment, a user can move the fabric tensioning apparatus 200 between a first, contracted configuration (see e.g., FIG. 15), wherein a substantial tensile force may not be applied to a fabric positioned thereon and a second, expanded configuration (see e.g., FIG. 14), wherein a substantial tensile force can be applied to the fabric or shirt 202 positioned thereon. This substantial tensile force can expand the fabric or the shirt 202 for treatment, tensioning, and/or dewrinkling.

In one non-limiting embodiment, a release mechanism can be used by a user to move the fabric tensioning apparatus 200 between the first, contracted configuration and the second, expanded configuration. In one non-limiting embodiment, a release mechanism 218 can be positioned on the collar 208 and/or the support beam 206 and can be configured to move between an engaged position (see e.g., FIGS. 15 and 17), where the release mechanism 218 contacts the first fabric engaging portion 214 and/or the second fabric engaging portion 216, and a disengaged positioned (see e.g., FIGS. 14, 16, and 18), where the release mechanism 218 is free from contact with the first fabric engaging portion 214 and/or the second fabric engaging portion 216. In one non-limiting embodiment, referring to FIGS. 16 and 18, the first and second fabric engaging portions 214 and 216 can comprise optional detents 220 configured to receive a portion of the release mechanism 218. These detents 220 can comprise a rough surface or a ridged surface, for example, to provide a sufficient coefficient of friction between the portions of the release mechanism 218 and the surface of the detents 220 to allow for suitable engagement between the portions of the release mechanism 218 and the detents 220. In one non-limiting embodiment, the release mechanism 218 can be pivotably attached to or otherwise attached to the collar 208 and/or the support beam 206 using a pin or a pivot, for example. In various embodiments, the release mechanism 218 can be normally biased into a position against the collar 208 and/or the support beam 206 using a biasing member, such as a spring, for example. As such, the release mechanism 218 can maintain the fabric tensioning apparatus 200 in the first, contracted configuration when engaged with the first and second fabric engaging portions 214 and 216. In one non-limiting embodiment, any other suitable release mechanism can be used with the fabric tensioning apparatus 200, such as a pin or a clip, for example.

In one non-limiting embodiment, a biasing member, such as biasing member 224, for example, can be configured to bias the fabric tensioning apparatus 200 from the first, contracted configuration into the second, expanded configuration. The biasing member can comprise a spring, an elastic cord, and/or a resilient member, for example. In one non-limiting embodiment, the biasing member 224 can normally bias the fabric tensioning apparatus 200 into the second, expanded configuration when the release mechanism 218 is in the disengaged position. In one non-limiting embodiment, the biasing member 224 can be configured to move the first fabric engaging portion 214 and/or the second fabric engaging portion 216 relative to and/or away from the support beam 206 when the release mechanism 218 is in the disengaged position (see e.g., FIGS. 14, 16, and 18) to expand the fabric tensioning apparatus 200 and apply suitable tension to the piece of fabric and/or the shirt 202. In one non-limiting embodiment, the biasing member 224 can apply a force of about 0.5 pounds to about 15 pounds, alternatively of about 1 pound to about 10 pounds, and alternatively of about 1.5 pounds to about 5.5 pounds, for example. In other embodiments, a heavier garment, weighing 3 pounds to 10 pounds may require a higher biasing force to properly tension the garment. In such an embodiment, the additional required force can be applied by the user manually. In other embodiments, the biasing member 224 can apply any other suitable force configured to move the fabric tensioning apparatus 200 between the first, contracted position and the second, expanded position and apply a suitable tensile force to the fabric situated on the fabric tensioning apparatus 200. In yet another embodiment, the biasing force can be applied manually by a user by pushing the collar 208 in a first direction and pulling on the hanging member 204 or 204' and/or the support beam 206, for example, in a second direction that is opposite to or substantially opposite to the first direction. In such an embodiment, the manually applied force can be maintained by engaging a locking mechanism to lock the collar 208 in a position along the support beam 206. In one non-limiting embodiment, the biasing of the fabric tensioning apparatus 200 can be sufficient to maintain tension on a fabric positioned thereon even if the fabric expands due to wetting, moistening, and/or heating of the fabric.

In one non-limiting embodiment, the force with which the first fabric engaging portion 214 and the second fabric engaging portion 216 engage the fabric positioned on the fabric tensioning apparatus 200 can be calculated. The fabric or garment weight (weight=mass of the garment times gravity) plus the biasing member force can equal the fabric engaging force applied by the first and second fabric engaging portions 214 and 216 to the fabric. In one example embodiment, the garment weight can be about 0.5 pounds to about 1.5 pounds, alternatively about 0.2 pounds to about 3 pounds, and alternatively about 1 pound to about 5 pounds, for example. The biasing member 224 can apply a force of about 0.5 pounds to about 2.5 pounds, alternatively about 0.1 pounds to about five pounds, and alternatively about 1 pound to about 10 pounds, for example. Depending on the garment weight and the force applied by the biasing member, the fabric engagement force can be about 1 pound to about 3 pounds, alternatively about 0.5 pounds to about 5 pounds, and alternatively about 3 pounds to about 10 pounds, for example. To reach a high fabric engagement force, a user may have to manually push the collar 208 in a direction away from the hanging member 204, for example, and then use the locking mechanism 207 and 209, or other suitable locking mechanism, to maintain the collar 208 in that position on the support beam 206. In one example, if the garment weight is 1 pound and the biasing member force is 2 pounds, the fabric engagement force is 3 pounds.

In one non-limiting embodiment, the biasing member 224 can comprise a first end 225 attached to the support beam 206 and a second end 227 engaged with an end portion of at least one cross member extending between the support beam 206 and at least one of the first fabric engaging portion 214 and the second fabric engaging portion 216. In another embodiment, the second end 227 can be attached to a pin 229 extending from an end portion of the at least one cross member. In one non-limiting embodiment, the biasing member 224 can be attached to the support beam 206 and/or movably engaged with the end portion of the at least one cross member via a pin, bolt, screw, rivet, and/or any other suitable mechanical members. Of course, the biasing member 224 can also be adhered to, formed with, and/or otherwise attached to the support beam 206 and/or the end portion of the cross member. In one non-limiting embodiment, the biasing member 224 can comprise a tension spring, for example, configured to pull the end portion of the cross member toward the collar 208, for example. In other embodiments, however, a compression spring can be used. The compression spring can push the end portion of the cross member toward the collar 208, for example.

In one non-limiting embodiment, the fabric tensioning apparatus 200 can comprise the at least one cross member extending between the support beam 206 and one of the first fabric engaging portion 214 and the second fabric engaging portion 216. The at least one cross member can support and, in some instances, bias at least one of the first fabric engaging portion 214 and the second fabric engaging portion 216. In one non-limiting embodiment, a cross member 226 can comprise a first end 228 and a second end 230. The first end 228 can be movably engaged with the support beam 206 and the second end 230 can be attached to, pivotably attached to, or movably engaged with the first fabric engaging portion 214. In such an embodiment, the support beam 206 can comprise at least one aperture or an elongate aperture 232, wherein the first end 228 or a pin 229 of the cross member 226 can be movably engaged with the support beam 206 within the elongate aperture 232 to permit relative movement between the first end 228 of the cross member 226 and the support beam 206.

In one non-limiting embodiment, the biasing member 224 can be operably engaged with the cross member 226 (or the first end 228 or the pin 229 of the cross member 226) and the support beam 206 and can be configured to bias the cross member 226 to expand the fabric tensioning apparatus 200 and apply tension to the fabric and/or the shirt 202, for example. In one non-limiting embodiment, the biasing member 224 can be configured to bias the first end 228 of the cross member 226 toward the collar 208 to move at least the first fabric engaging portion 214 away from the support beam 206 and apply tension to the fabric and/or the shirt 202. Depending on the configuration of the support beam 206 and the cross member 226, the biasing member 224 can be configured to bias the first end 228 of the cross member 226 away from the collar 208 to move at least one of the first fabric engaging portion 214 and/or the second fabric engaging portion 216 from the first, contracted configuration into the second, expanded configuration.

In one non-limiting embodiment, the fabric tensioning apparatus 200 can also comprise a second cross member 234 engaged or movably engaged with the support beam 206 on its first end 236 or via pin 229 and engaged or movably engaged with the second fabric engaging portion 216 on its second end 238. In such an embodiment, the cross member 226 and the second cross member and 234 can both be operably engaged with the biasing member 224 such that they can be moved by the biasing member 224 to move the fabric tensioning apparatus 200 between the first, contracted configuration and the second, expanded configuration. In other embodiments, a separate biasing member can be operably engaged with the cross member 226 and the second cross member 234, for example. In one non-limiting embodiment, a third cross member 240 can be engaged or movably engaged with the support beam 206 on its first end 242 or via a pin 231 and engaged or movably engaged with the first fabric engaging portion 214 on its second end 244. Likewise, a fourth cross member 246 can be engaged or movably engaged with the support beam 206 on its first end 248 or via the pin 231 and engaged or movably engaged with the second fabric engaging portion 216 on its second end 250. The various cross members can be used to support the first and second fabric engaging portions 214 and 216 and provide rigid support to the fabric tensioning apparatus 200. In one non-limiting embodiment, the second cross member 234, the third cross member 240, and the fourth cross member 246 can be optional. In other various embodiments, the third cross member 240 and the fourth cross member 246 can be optional.

Figure 15:
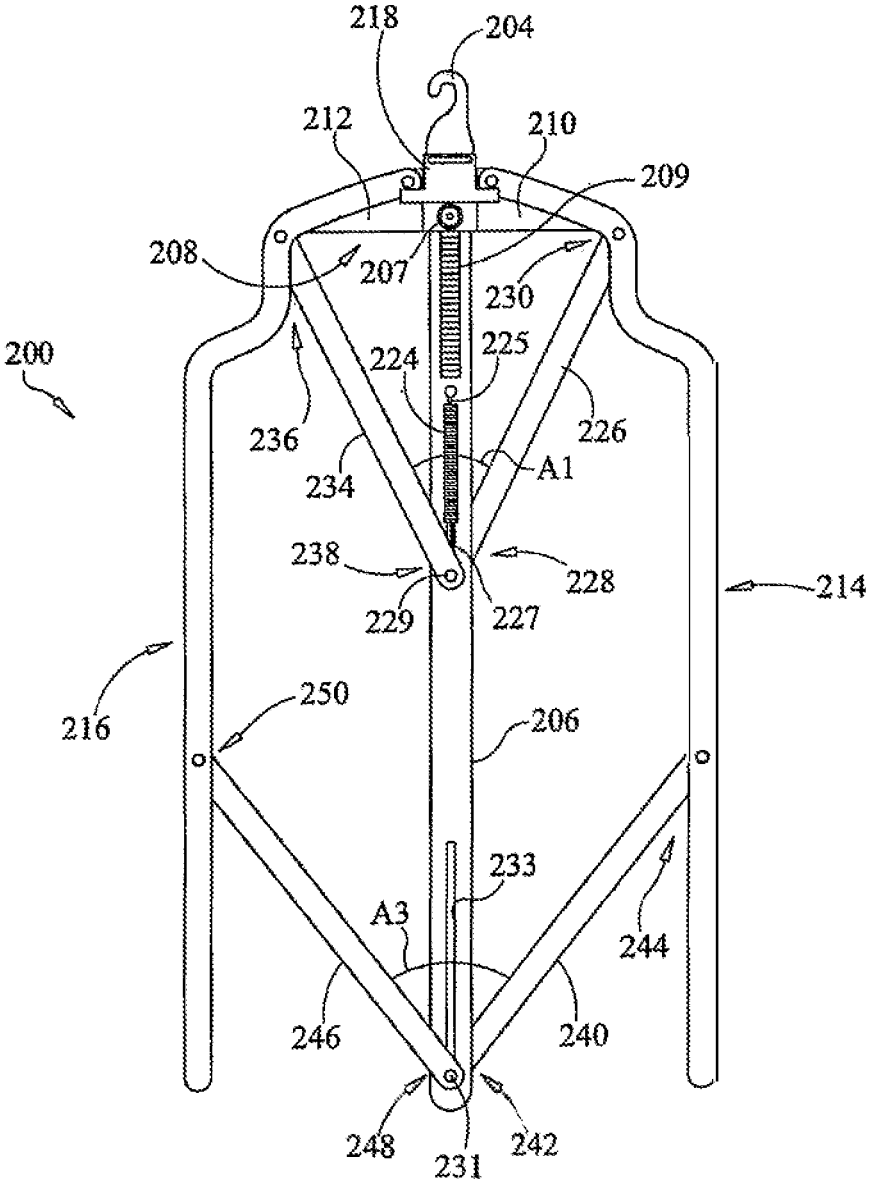
FIG. 15 is a front view of the fabric tensioning apparatus of FIG. 14, in a contracted configuration and without the piece of fabric positioned thereon, according to one non-limiting embodiment.
Figure 16:
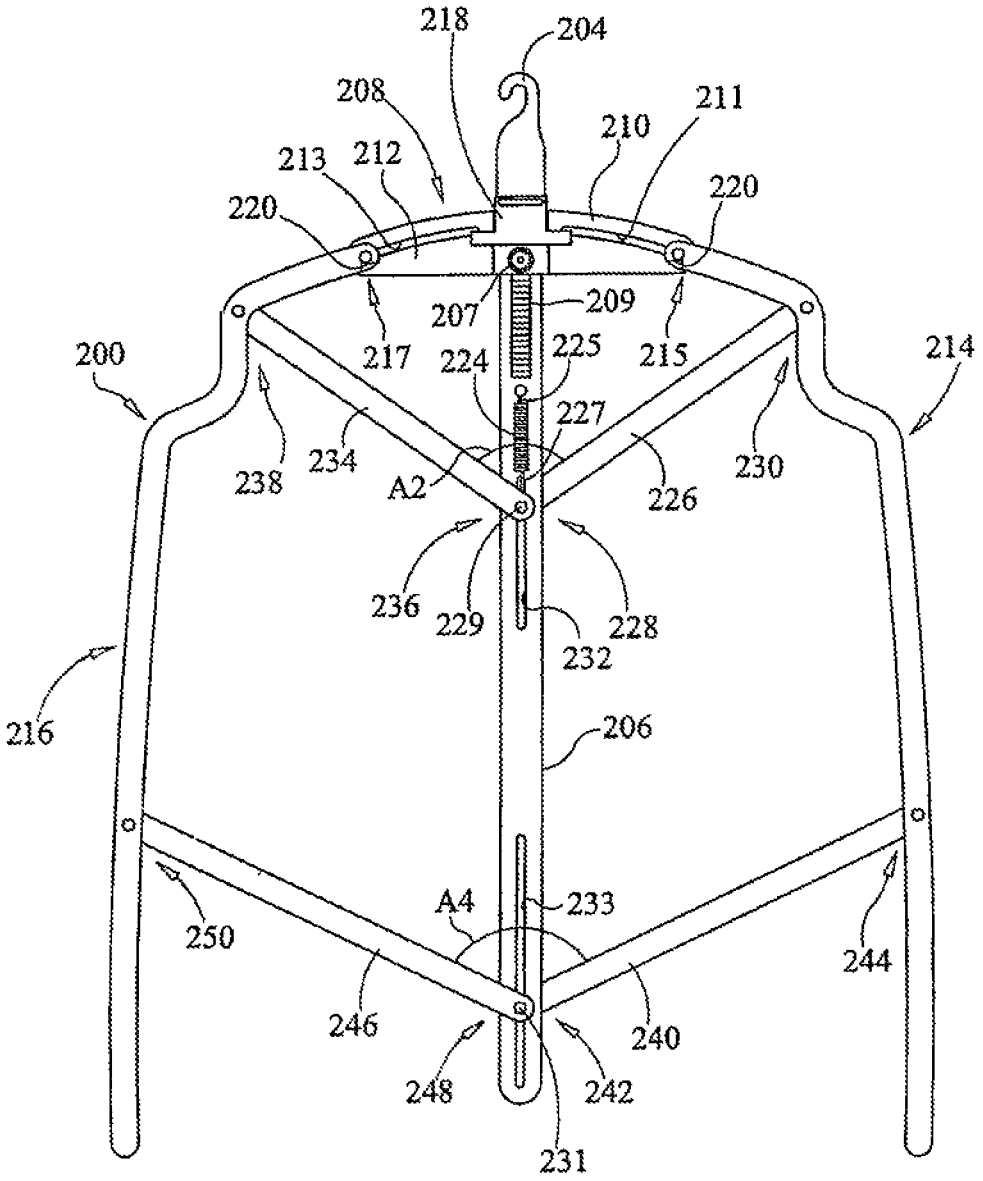
FIG. 16 is a front view of the fabric tensioning apparatus of FIG. 15 in an expanded configuration, according to one non-limiting embodiment.

In one non-limiting embodiment, referring to FIGS. 15 and 16, the cross member 226 and the third cross member 240 can engage the support beam 206 on a back side of the support beam 206 and the second and fourth cross members 234 and 240 can engage the support beam 206 on the front side of the support beam 206. Those of skill in the art will recognize that other orientations can be provided within the scope of the present disclosure. For example, all of the cross members could engage the support beam 206 on the back side of the support beam 206 and/or the front side of the support beam 206. Further, the various first ends of the various cross members can be attached to each other, or configured to engage each other, at a point proximate to the at least one elongate aperture 232, for example.

In one non-limiting embodiment, the first end 228 of the cross member 226 and the first end 236 of the second cross member 234 can be engaged with, or movably engaged with, the at least one elongate aperture 232 in the support beam 206. In one non-limiting embodiment, the first end 228 can comprise the pin 229 extending therefrom and, likewise, the first end 236 can comprise a pin 229 extending therefrom. The pins 229 can be engaged with the at least one elongate aperture 232 to allow the first end 228 of the cross member 226 and the first end 236 of the second cross member 234 to be slidably or movably engaged with the support beam 206 within the at least one elongate aperture 232. Such engagement can allow the cross members 226 and 234 to move relative to the support beam 206. In one non-limiting embodiment, the first end 228 can engage the at least one elongate aperture 232 from the rear side of the support beam 206 and the first end 236 can engage the at least one elongate aperture 232 from the front side of the support beam 206. In any event, the biasing member 224 can be operably engaged with the pins 229 and/or the first end 228 and/or the first end 236 such that the cross member 226 and the second cross member 234 can be biased by the biasing member 224. In one non-limiting embodiment, the first end 228 and the first end 236 and/or the pins 229 can be attached to each other such that the biasing member 224 can be attached to any region of the first end 228, the second end 236, and/or the pins 229, for example. As such, the cross member 226 and the second cross member 234 can both be biased at the same time, for example.

In one non-limiting embodiment, referring to FIGS. 15 and 16, the third cross member 240 and the fourth cross member 246 can be engaged or movably engaged with the at least one elongate aperture 232 in a similar fashion as the cross member 226 and the second cross member 234. In one non-limiting embodiment, however, a separate elongate aperture 233 can be provided for engagement with the first end 242 of the third cross member 240, the first end 248 of the fourth cross member 246, and/or pins 231 extending from the first ends 242 and 248. Another optional biasing member (not illustrated) can be supplied proximate to the separate elongate aperture 233 and can be engaged to the first end 242 of the third cross member 240, the first end 248 of the fourth cross member 246, and/or to the pins 231 extending from the first end 242 and the first end 248. The third and fourth cross members 240 and 246 can be biased in the same or a similar fashion as that discussed herein with respect to the cross member 226 and the second cross member 234. In one non-limiting embodiment, the biasing element 224 acting upon the cross member 226 and/or the second cross member 234 can be sufficient to bias the third and fourth cross members 240 and 246 from the configuration illustrated in FIG. 15 to the configuration illustrated in FIG. 16, for example.

In one example non-limiting embodiment, referring to FIGS. 15 and 16, the cross member 226 and the second cross member 234 can each have a length of about 14 inches, while the third cross member 240 and the fourth cross member 246 can each have a length of about 15 inches. The cross member 226 and the second cross member 234 can form a right angle or an acute angle therebetween, such as an angle in the range of about 60 degrees to about 90 degrees, for example. The about 60 degree angle, A1, between the cross member 226 and the second cross member 234 (see FIG. 15), can be formed when the fabric tensioning apparatus 200 is in the first, contracted configuration and the about 90 degree angle, A2, between the cross member 226 and the second cross member 234 (see FIG. 16), can be formed when the fabric tensioning apparatus 200 is in the second, expanded configuration. The third cross member 240 and the fourth cross member 246 can form an angle therebetween, such as an angle in the range of about 70 degrees to about 180 degrees, for example. The about 70 degree angle, A3, between the third cross member 240 and the fourth cross member 246 (see FIG. 15), can be formed when the fabric tensioning apparatus 200 is in the first, contracted configuration and the about 180 degree angle, A4, between the third cross member 240 and the fourth cross member 246 (see FIG. 16), can be formed when the fabric tensioning apparatus 200 is in the second, expanded configuration. Those of skill in the art will recognize that other suitable angles, including obtuse angles, can be formed between the cross member 226 and the second cross member 234 and/or the third cross member 240 and the fourth cross member 246 depending on the configuration of the fabric tensioning apparatus 200.

In one non-limiting embodiment, when the release mechanism 218 is moved from the engaged position (see e.g., FIGS. 15 and 17) into the disengaged position (FIGS. 14, 16, and 18), the cross member 226 can move the first fabric engaging portion 214 away from the first side of the support beam 206 and the second cross member 234 can move the second fabric engaging portion 216 away from the second side of the support beam 206 to expand the fabric tensioning apparatus 200 and apply tension to a piece of fabric and/or the shirt 202 positioned thereon. In other embodiments, only the cross member 226 may move the first fabric engaging portion 214 away from the first side of the support beam 206, while the second cross member 234 may not move the second fabric engaging portion 216 relative to the support beam 206. In still other embodiments, the cross member 226 and the third cross member 240 can move the first fabric engaging portion 214 away from the first side of the support beam 206 and the second and fourth cross members 234 and 246 can move the second fabric engaging portion 216 away from the second side of the support beam 206 to expand the fabric tensioning apparatus 200 and apply tension to the fabric and/or the shirt 202 positioned thereon. It will be understood that movement of the first and second fabric engaging portions 214 and 216 can be accomplished owing to the biasing member 224, or other biasing members, when the release mechanism 218 is in the disengaged position.

In one non-limiting embodiment, the release mechanism 218 may not be provided and a user can manually move the fabric tensioning apparatus 200 from the second, expanded configuration into the first, contracted configuration to position a fabric thereon. In such an embodiment, the biasing member 224 can normally bias the fabric tensioning apparatus 200 into the second, expanded configuration. As such, a user may need to pull the collar 208 toward the hanging member 204 or 204' to move the fabric tensioning apparatus 200 into the first, contracted configuration to position the fabric thereon. Once the fabric is positioned thereon, the user can allow the fabric tensioning apparatus 200 to expand into the second, expanded configuration.

In other embodiments, the release mechanism 218 and the biasing member 224 can be eliminated and the user can manually move the fabric tensioning apparatus 200 between the first, contracted configuration and the second, expanded configuration. Once the user has positioned a fabric on the fabric tensioning apparatus 200, the user can then expand the fabric tensioning apparatus 200 by holding the hanging member 204 and pushing the collar 208 in a direction away from the hanging member 204 and thereby expanding the fabric tensioning apparatus 200 into a configuration wherein the fabric tensioning apparatus 200 applies tension to the fabric positioned thereon. Once the tension is applied to the fabric, the user can engage, rotate, or otherwise actuate the locking mechanism to essentially lock the collar 208 at a suitable position on the support beam 206 such that tension can be applied to the fabric. Once the tension has been applied to the fabric for a suitable period of time and/or the fabric has been treated, washed, and/or refreshed, for example, the user can disengage the locking mechanism, slide the collar 208 in a direction toward the hanging member 204, and remove the fabric from the fabric tensioning apparatus 200.

Figure 17:
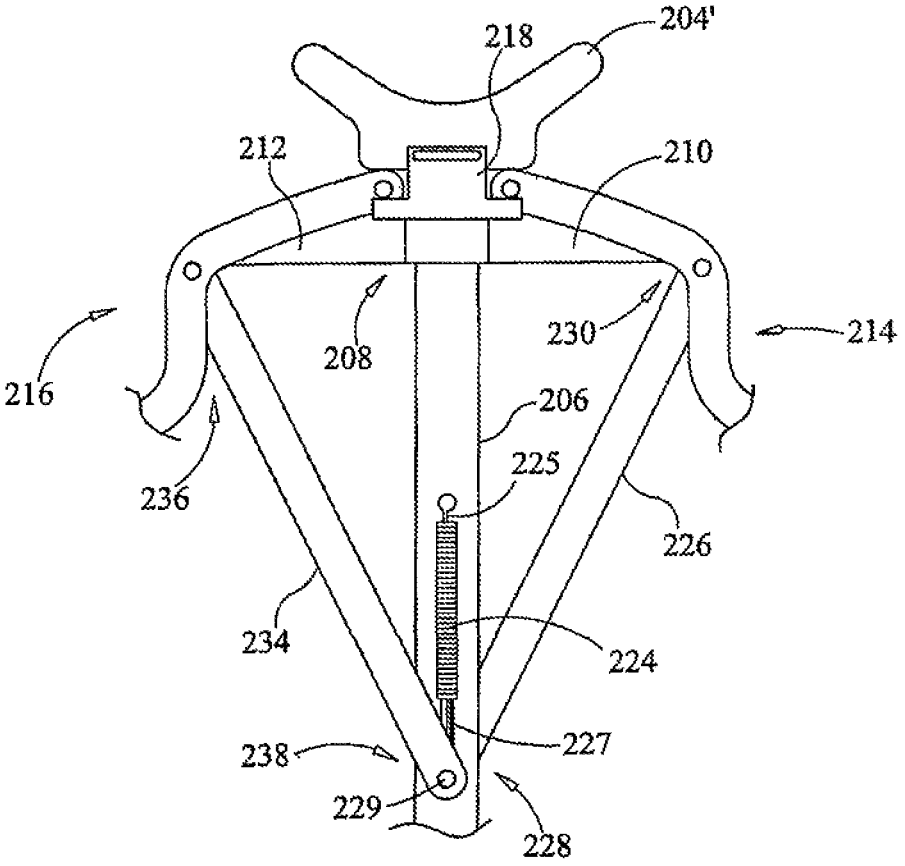
FIG. 17 is a partial front view of the fabric tensioning apparatus of FIG. 15 according to one non-limiting embodiment.
Figure 18:
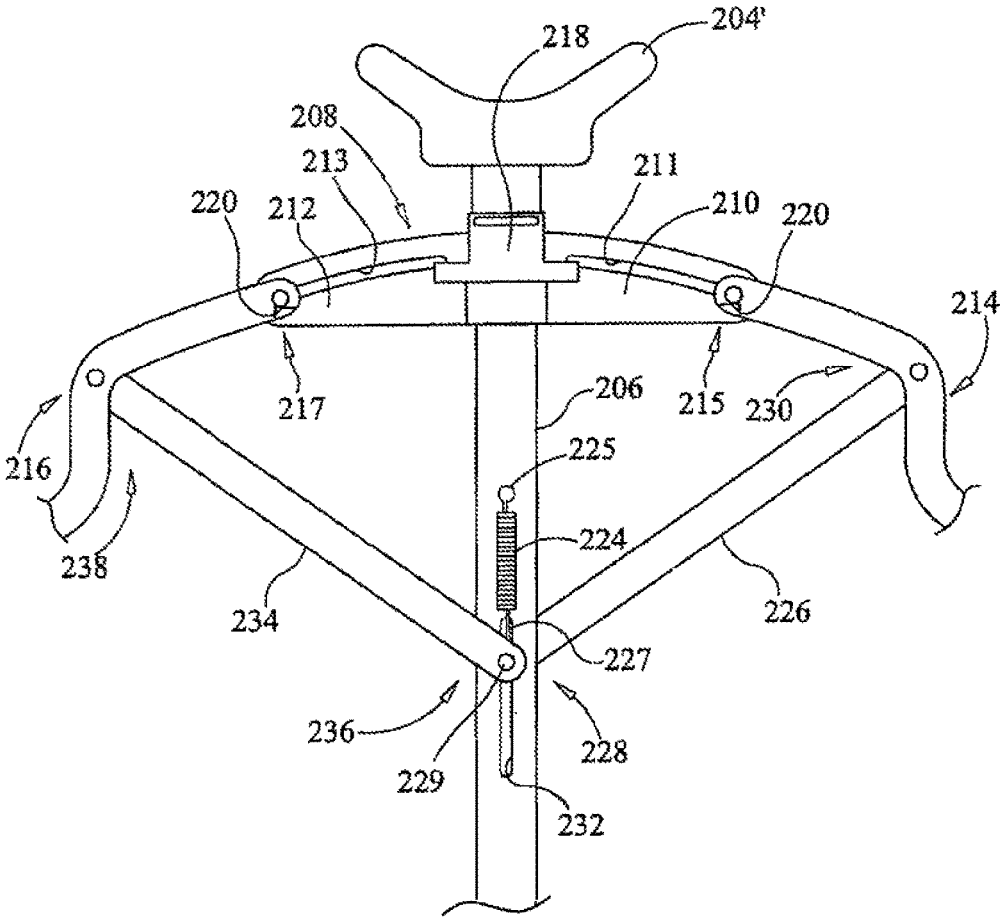
FIG. 18 is a partial front view of the fabric tensioning apparatus of FIG. 16 according to one non-limiting embodiment.

In one non-limiting embodiment, still referring to FIGS. 14-18, the collar 208 can define an aperture positioned at least partially intermediate the first projection 210 and the second projection 212 such that the support beam 206 can be slidably or movably engaged with the collar 208 within the aperture at least when the release mechanism 218 is free from contact with the first fabric engaging portion 214 and/or the second fabric engaging portion 216 (i.e., the disengaged position). As illustrated in FIGS. 15 and 17, the collar 208 can be positioned proximate to or abut the hanging member 204 or 204' when the fabric tensioning apparatus 200 is in the first, contracted position. In this position, the collar 208 may not slide with respect to the support beam 206 owing to the engagement of the portions of the release mechanism 218 with the first and second fabric engaging portions 214 and 216. As illustrated in FIGS. 16 and 18, the collar 208 can slide or move relative to the support beam 206 when the release mechanism 218 is in the disengaged position. As such, a portion of the support beam 206 can extend through the collar 208 to allow the fabric tensioning apparatus 200 to expand into the second, expanded configuration.

Figure 19:
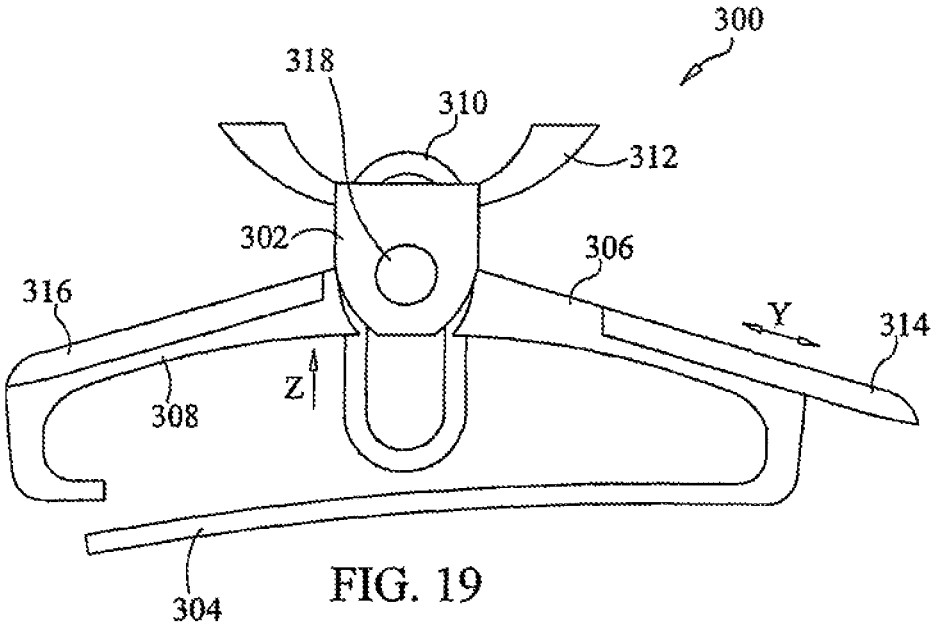
FIG. 19 is a front view of a fabric hanger in a first configuration, which is configured for use with a fabric treating system, according to one non-limiting embodiment.
Figure 20:
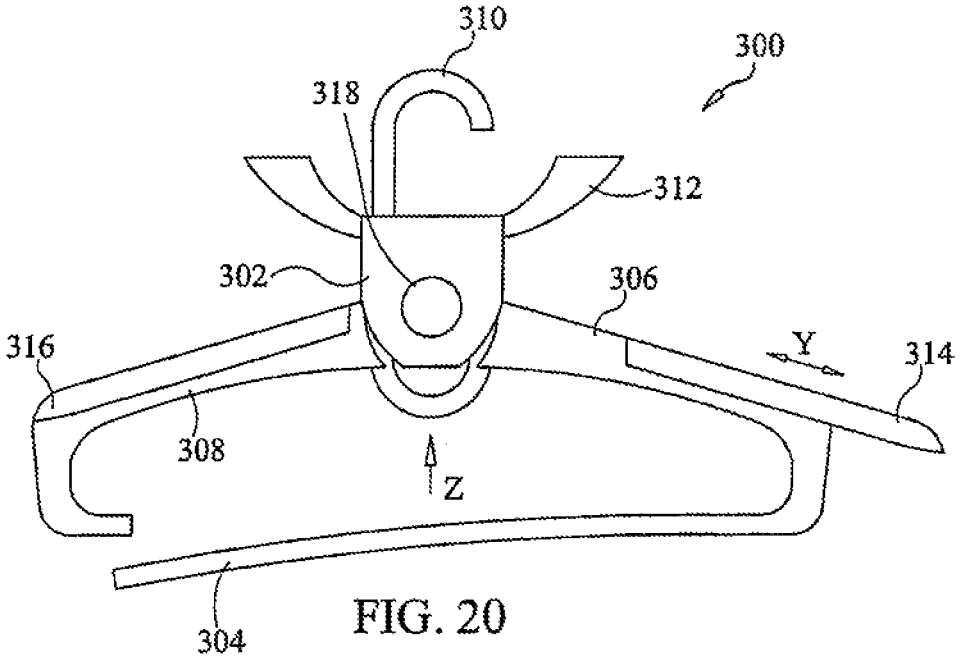
FIG. 20 is a front view of the fabric hanger of FIG. 19 in a second configuration according to one non-limiting embodiment.

In one non-limiting embodiment, referring to FIGS. 19 and 20, a fabric hanger 300 can comprise a collar 302 comprising an end portion and an aperture defined in the collar 302. The fabric hanger 300 can also comprise a cross support 304 configured to support a fabric thereon or there over. A first arm 306 can extend from the collar 302 in a first direction and a second arm 308 can extend from the collar 302 in a second direction. The first and second arms 306 and 308 can be configured to support at least one fabric thereon. The fabric hanger 300 can comprise a first hanging member 310 slidably engaged with the collar 302 within the aperture in the collar 302 and a separate, second hanging member 312 extending from the end portion of the collar 302. The first hanging member 310 can be movable between a first, retracted position (see e.g., FIG. 19) and a second, extended position (see e.g., FIG. 20) relative to the collar 302 in the direction generally indicated by arrow "Z."

In one non-limiting embodiment, the first hanging member 310 can be used to hang the fabric hanger 300 over a pole, a rod, or other support in a closet or in a fabric treating system, for example. In various embodiments, the second hanging member 312 can be used to hang the fabric hanger 300 within a fabric treating system, such as fabric treating system 10, for example. In one non-limiting embodiment, the first hanging member 310 can be used to hang or suspend the fabric hanger 300 in a closet prior to and/or after a fabric (not illustrated) positioned on the fabric hanger 300 has been treated by a fabric treating system and the second hanging member 312 can be used to hang or suspend the fabric hanger 300 within a fabric treating system, for example. As such, the fabric hanger 300 can be used internal to or external to a fabric treating system, thus providing multiple uses for the fabric hanger 300.

If a fabric, such as a shirt, for example, was positioned on the fabric hanger 300 and was hung from a rod in a closet using the first hanging member 310 in the second, extended position, a user could pick up the fabric hanger 300, move the first hanging member 310 from the second, extended position (FIG. 20) into the first, retracted position (FIG. 19). The user could then position the fabric hanger 300 and a shirt positioned thereon within a fabric treating system for treatment (e.g., washing, refreshing, and/or dewrinkling). The second fabric hanger 312 can be used to engage the fabric hanger 300 with a support member, such as support member 26 described above, for example, of the fabric treating system.

In one non-limiting embodiment, still referring to FIGS. 19 and 20, a first slide 314 can be positioned on and/or operably engaged with the first arm 306. The first slide 314 can be translatable, in the direction generally indicated by arrow "Y," about the first arm 306 at least between a first position and a second, extended position. The first slide 314 is illustrated in the second, extended position in FIGS. 19 and 20, while a second slide 316 positioned on and/or operably engaged with the second arm 308 is illustrated in the first position. Those of skill in the art will recognize that the first slide 314 and/or the second slide 316 can also be moved into any suitable intermediate position between the first position and the second, extended position. The movement of the first and second slides 314 and 316 can allow a user to expand the fabric hanger 300 from a first position into a second, extended position, wherein at least one of the first slide 314 and the second slide 316 is at least partially extended from one of the first arm 306 and the second arm 308. Such movement of the first and/or second slides 314 and 316 can allow a fabric, such as a shirt, for example, to be tensioned and/or expanded on the fabric hanger 300 at least within the shoulder portions of the shirt.

In one non-limiting embodiment, the first and second slides 314 and 316 can be moved manually about the first and second arms 306 and 308. In the case of manual movement, the first and second slides 314 and 316 can be snap-fit, press-fit, and/or tightly fit to the first and second arms 306 and 308 such that a user can move the slides about the arms and/or remove the slides from the arms and position the slides in a suitable location on the arms. In other embodiments, the slides can have at least one projection or at least one hook extending from portions of the slides that are configured to engage a top surface of the arms. The arms can have a series of recesses, detents, or other suitable features at a location configured to receive the at least one projection or the at least one hook of the slides. The at least one projection or the at least one hook can be engaged with at least one recess or detent, for example, to attach the slides to the arms.

As such, the user can move the slides about the arms to any suitable location such that the fabric hanger 300 can be expanded to support the shoulder portions of a shirt or other fabric, for example.

In another embodiment, the first and second slides 314 and 316 can be operably engaged with an adjustment mechanism (not illustrated) configured to move the slides about the first and second arms 306 and 308. In one non-limiting embodiment, the adjustment mechanism can comprise a gear, such as a pinion gear, for example, operatively engaged with at least one rack. In one non-limiting embodiment, a rotatable handle 318 can be operatively engaged with the gear such that as the handle 318 is rotated, the gear can also rotate. In one non-limiting embodiment, an adjustment mechanism can be provided for each of the first slide 314 and the second slide 316. In any event, the adjustment mechanism, in some embodiments, can convert rotational movement of the handle 318 and thereby the gear, into linear movement of the rack owing to teeth of the gear being meshingly engaged with teeth of the rack.

In one non-limiting embodiment, the rack or racks can be positioned within channels defined in the first arm 306 and the second arm 308. The racks can be operatively engaged with the slides, such that as a user rotates the handle 318 operably engaged with the gear, the racks can translate, in a linear direction, about the arms, thereby moving the slides about the arms. The handle 318 can comprise a suitable gripping surface. The handle 318 of the adjustment mechanism can be positioned on the collar 302, for example. As discussed above, two adjustment mechanisms can be provided such that a user can rotate or move a first handle to move the rack within the first arm 306 and can rotate or move a second handle to move the rack within the second arm 308. As a result, the user can move the first slide 314 by rotating the first handle and can move the second slide 316 by rotating the second handle, for example. In other embodiments, other suitable mechanical members or assemblies can be used to translate the first slide 314 about the first arm 306 and/or the second slide 316 about the second arm 308.

In various embodiments, an optional kit or starter kit can be used in conjunction with the fabric treating systems and/or the fabric tensioning systems of the present disclosure. In one non-limiting embodiment, referring to FIG. 21, the starter kit 400 can comprise one or more first fabric hangers 402, one or more second fabric hangers 404, instructions 406, one or more containers of a fabric treatment solution 408, a compact disk or DVD 410, one or more pocket tensioners 412, and/or one or more weights (not illustrated) configured to be attached to a fabric to tension the fabric. A user that purchases a fabric treating system may separately purchase the starter kit 400, or the starter kit 400 may be provided to the user upon purchase of the fabric treating system. As described in further detail below, the starter kit 400 can, in some instances, provide the user with accessories for use with fabric treating systems and/or fabric tensioning systems and also provide the user with instructions regarding the operation of the fabric treating systems, the fabric tensioning systems, and/or the various components of the systems. In one non-limiting embodiment, referring again to FIG. 21, the one or more first fabric hangers 402, can be similar to or the same as the fabric hanger 300 described herein. As such, the one or more first fabric hangers 402 will not be described again here for the sake of brevity. In one non-limiting embodiment, the one or more second fabric hangers 404 can be similar to the fabric hanger 300, but the first slide 314 and the second slide 316 can be eliminated, for example. The one or more second fabric hangers 404 can be used for refreshing light weight garments or fabrics, such as blouses or dress shirts, for example. Of course, any other fabric hangers and/or fabric tensioning apparatuses can be provided with the starter kit 400 either in addition to or in lieu of the first and second fabric hangers 402 and 404. As discussed above, in one non-limiting embodiment, the starter kit 400 can comprise instructions 406 and/or a compact disk and/or a DVD 410. The instructions 406 and/or the compact disk or DVD 410 can provide details regarding the operation and use of a fabric treating system, a fabric tensioning system, a fabric tensioning apparatus, and/or the various fabric hangers discussed herein. In other embodiments, the instructions 406 and/or the compact disk or DVD 410 can provide details about any of the other components of the systems and apparatuses of the present disclosure. In still other embodiments, the instructions 406 and/or the compact disk or DVD 410 can comprise warranty information and/or promotional material, for example, and/or other suitable information or materials that would be helpful to a user. In one non-limiting embodiment, the compact disk or DVD 410 can provide video instructions, playable on a computer or on a DVD player, for example, such that the user can be visually instructed on the use and operation of a fabric treating system, a fabric tensioning system, a fabric treating apparatuses, and/or various fabric hangers, for example.

Figure 21:
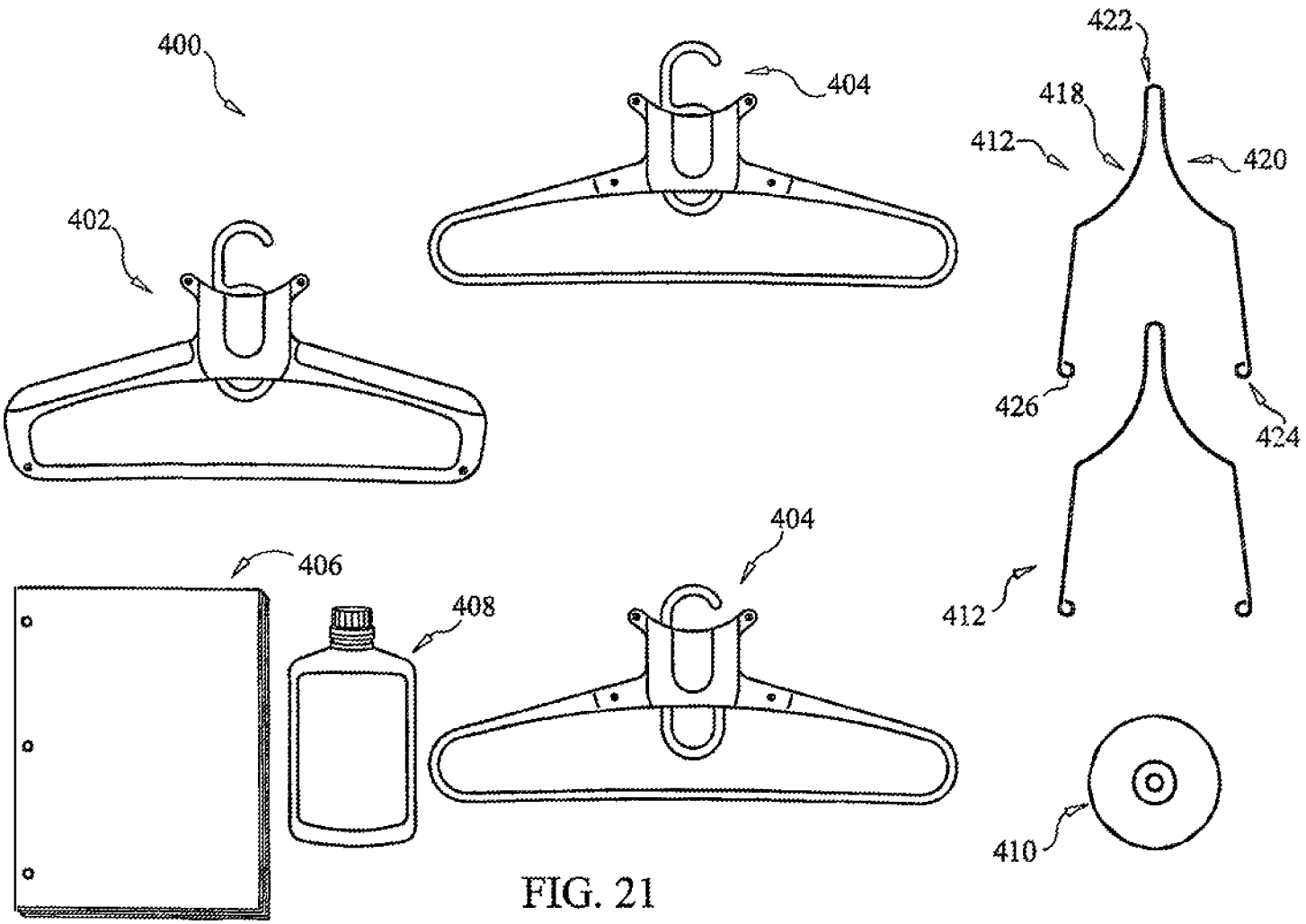
FIG. 21 is a view of a starter kit for use with a fabric treating system according to one non-limiting embodiment.
Figure 22:
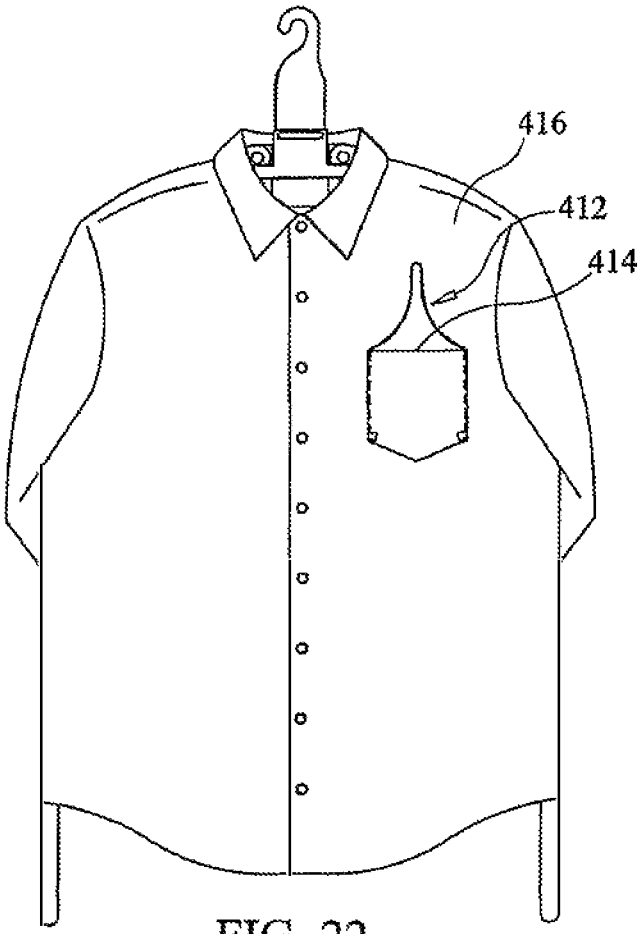
FIG. 22 is a front view of a pocket tensioner being used to tension a pocket of a shirt according to one non-limiting embodiment.

In one non-limiting embodiment, referring to FIGS. 21 and 22, the one or more pocket tensioners 412 of the starter kit 400 are configured to be inserted into a pocket 414 of a garment, such as a shirt 416 or a pair of pants, for example, to tension the pocket and eliminate, or at least reduce, wrinkles within the pocket 414.

In various embodiments, each pocket tensioner 412 can comprise a first side 418 and a second side 420. The first side 418 and the second side 420 can be movable toward each other, but the pocket tensioner 412 can be normally biased into the configuration illustrated in FIG. 21. In other embodiments, the first side 418 can be biased toward the second side 420 or the second side 420 can be biased toward the first side 418, for example. In one non-limiting embodiment, the first side 418 can be movable between a first position, where the first side 418 is a first distance from the second side 420, and a second position, where the first side 418 is a second distance from the second side 420. The first distance can be greater than or different than the second distance. In various embodiments, the pocket tensioner 412 can be normally biased into the first position.

In one non-limiting embodiment, referring to FIG. 22, prior to or when the pocket tensioner 412 is being inserted into the pocket 414 of the shirt 416, the first side 418 can be compressed or moved toward the second side 420, for example, to reduce the lateral width of the pocket tensioner 412 and allow a portion of the pocket tensioner 412 to fit into the pocket 414. Once the portion of the pocket tensioner 412 is positioned within the pocket 414, it can expand into its normally biased position to tension the pocket 414. In one non-limiting embodiment, the first side 418 and the second side 420 can be attached to each other at a first end 422 and free from attachment to each other at a second end 424. In various embodiments, the portions of the first and second sides 418 and 420 proximate to or at the second end 424 can optionally comprise arcuate portions 426. The arcuate portions 426 on the first side 418 can extend from the first side 418 toward the second side 420 and, similarly, the arcuate portion 426 on the second side 420 can extend from the second side 420 toward the first side 418. The arcuate portions 426 on the second end 424 of the pocket tensioner 412 can prevent, reduce, or at least inhibit, portions of the pocket tensioner 412 proximate to the second end 424 from snagging or being caught on interior portions of the pocket 414 of the shirt 416, when the pocket tensioner 412 is inserted and/or removed from the pocket 414. In certain embodiments, the arcuate portions 426 can at least partially form a loop on the second end 424 of the first side 418 and on the second side 420.

In one non-limiting embodiment, the biasing of the pocket tensioner 412 can occur owing to the configuration of the pocket tensioner 412 and the resiliency of the material that at least partially comprises the pocket tensioner 412. In one non-limiting embodiment, the pocket tensioner 412 can be comprised of a resilient material, such as a metal or a plastic, for example. Of course, those of skill in the art will recognize that other suitable materials can also be used to form the pocket tensioner 412. In various embodiments, a first portion of the pocket tensioner 412 can be comprised of a resilient material and a second portion of the pocket tensioner 412 can be comprised of a rigid or a semi-rigid material, for example. In one non-limiting embodiment, the pocket tensioner 412 can be comprised of a material that can resist degradation within the environment of a fabric treating system. In various embodiments, the pocket tensioner 412 can be used independent of a fabric treating apparatus, a fabric treating system, and/or a fabric tensioning system. In one non-limiting embodiment, the pocket tensioner 412 can be used while a shirt is hanging in a closet, for example, to maintain the pocket in a tensioned state during storage.

Figure 23:
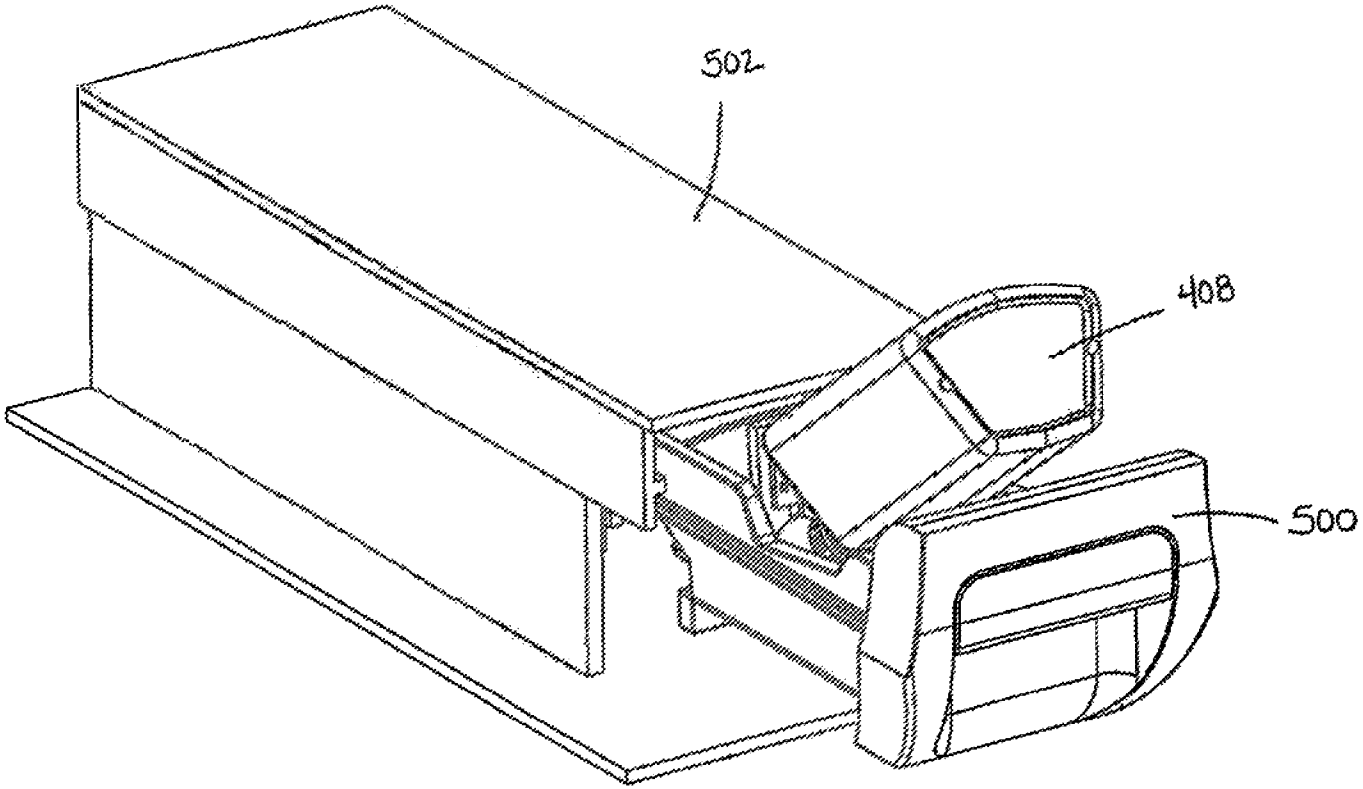
FIG. 23 is a perspective view of a drawer configured to be used with a fabric treating system according to one non-limiting embodiment.

In one non-limiting embodiment, referring to FIGS. 21 and 23, the container 408 of the starter kit 400 can comprise a fabric treatment solution configured to be used to treat fabrics positioned within the fabric treating systems described herein. In one non-limiting embodiment, referring to FIG. 23, an example fabric treating system solution drawer 500, which can be used with a modified version of the fabric treating system 110, is illustrated. The fabric treating system solution drawer 500 can move into and out of a housing 502 having components, such as a pump and a fluid extraction tube, for example, that can enable extraction of the fabric treatment solution from within the container 408. Once the fabric treatment solution is extracted from the container 408 within the fabric treating system solution drawer 500, the fabric treating system can provide the fabric treatment solution to at least one dispensing head of the fabric treating system, such as dispensing head 150 of the fabric treating system 110, for example, such that the fabric treatment solution can be sprayed onto fabric within the fabric treating system. In one non-limiting embodiment, the container 408 can be inserted into the fabric treating system solution drawer 500 and then punctured by a fluid extraction tube, such as a needle, for example, to allow the fabric treatment solution to be extracted from the container 408 and used by the fabric treating system. The container 408 can be refillable or replaceable after at least most of the fabric treatment solution is extracted from the container 408. Of course, other starter kits can comprise a reservoir, similar to or the same as reservoir 172 described above. In still other embodiments, other suitable containers or reservoirs comprising a fabric treatment solution can be provided with a starter kit.

While a non-limiting example of the starter kit has been described herein, those of skill in the art will recognize that other accessories, materials, devices, and/or information can be provided within a starter kit. Further, any number of the accessories, materials, devices, and/or pieces of information can be provided with the starter kit. For example, in one non-limiting embodiment, a starter kit can comprise five hangers, three containers of a fabric treatment solution, and four pocket tensioners, for example, either in addition to or in lieu of the components of the starter kit 400 described above. In certain embodiments, the starter kit can further comprise band, cords, clips, and/or clamps, for example, which can be used to tension fabric within the fabric treating system.

In one non-limiting embodiment, a method of treating a fabric can comprise placing a fabric into the fabric receiving space of the fabric treating systems described herein, depositing a fabric treatment composition upon at least a portion of the fabric, actuating a heating element, and venting the fabric treating system. In one non-limiting embodiment, the step of depositing the fabric treatment composition can comprise dispensing the fabric treatment composition onto the fabrics, such as by spraying, vaporizing, or misting, for example. In one non-limiting embodiment, the step of actuating the heating element can comprise a step of heating the air within the fabric treating system to at least about 80° C., alternatively at least about 70° C., and alternatively at least about 50° C., for example. In another embodiment, the method of treating the fabric is completed within about 15 minutes, alternatively within about 10 minutes, and alternatively within about 8 minutes, for example.

In one non-limiting embodiment, a method of tensioning a fabric within a fabric treating system can comprise attaching a fabric hanger having a fabric thereon to a support member, attaching a first fabric grasper of the fabric treating system to a portion of the fabric, and tensioning the fabric at least partially intermediate the support member and the first fabric grasper.

In one non-limiting embodiment, a method of tensioning a fabric can comprise providing a fabric tensioning apparatus, positioning a fabric on the fabric tensioning apparatus, and expanding the fabric tensioning apparatus from a first, contracted configuration to a second, expanded configuration to tension the fabric.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description are, in relevant part, incorporated herein by reference. The citation of any document is not to be construed as an admission that it is prior art with respect to the present disclosure. To the extent that any meaning or definition of a term in the present disclosure conflicts with any meaning or definition of the term in a document incorporated by reference, the meaning or definition assigned to the term in the present disclosure document shall govern.

While particular non-limiting embodiments of the present disclosure have been illustrated and described, those of skill in the art will recognize that various other changes and modifications can be made without departing from the spirit and scope of the present disclosure. It is therefore intended to cover in the appended claims all such changes and modifications that are within the scope of the present disclosure.

What is claimed is:

1. A fabric treating system, comprising:

an enclosure defining a fabric receiving space:

a support member disposed within and movably engaged with the enclosure, the support member configured to support a piece of fabric within the fabric receiving space;

a first tensioning beam disposed on a first interior wall within the enclosure;

a second tensioning beam disposed on a second interior wall opposite the first interior wall; and a fabric tensioning system disposed within the enclosure and comprising:

a first fabric grasper attached to the piece of fabric and applying tension to the piece of fabric in a direction away from the second tensioning beam; and a second fabric grasper attached to the piece of fabric and applying tension to the piece of fabric in a direction away from the first tensioning beam.

2. The fabric treating system of claim 1, wherein the first tensioning beam defines an opening between the first tensioning beam and the first interior wall, and the second tensioning beam defines an opening between the second tensioning beam and the second interior wall.

3. The fabric treating system of claim 1, wherein the support member is fixedly attached to a top interior wall of the enclosure and supports a hanger.

4. The fabric treating system of claim 3, wherein the hanger includes a collar having an aperture defined therein.

5. The fabric treating system of claim 4, wherein the hanger includes a first arm extending from the collar in a first direction, and a second arm extending from the collar in a second direction, wherein the first and second arms are configured to support the piece of fabric.

6. The fabric treating system of claim 1, wherein the first fabric grasper applies tension to the piece of fabric in a first direction and the second fabric grasper applies tension to the piece of fabric in a second direction generally orthogonal to the first direction.

7. The fabric treating system of claim 1, further comprising:

at least a third fabric grasper configured to be attached to the piece of fabric to apply tension to the piece of fabric.

8. The fabric treating system of claim 1, further comprising:

one of a resilient member and an extendable member configured to bias the support member proximate to the first interior wall, wherein one of the resilient member and the extendable member is configured to permit relative movement of the support member with respect to the first wall and permit tensioning of the piece of fabric.

9. A fabric treating system, comprising:

a support member movably engaged with a first wall and configured to support a piece of fabric within a fabric receiving space; and a fabric tensioning system comprising:

a first fabric grasper attached to a piece of fabric to apply downward tension to the piece of fabric toward a first side of the enclosure;

a second fabric grasper attached to the piece of fabric to apply downward tension to the piece of fabric toward a second side of the enclosure;

a third fabric grasper attached to the piece of fabric to apply downward tension to the piece of fabric toward a bottom of the enclosure; and at least one static tensioning beam engaged with the piece of fabric.

10. The fabric treating system of claim 9, wherein the support member is fixedly attached to the first wall, and wherein the first fabric grasper applies tension to the piece of fabric in a first direction and the second fabric grasper applies tension to the piece of fabric in a second direction generally orthogonal to the first direction.

11. The fabric treating system of claim 9, wherein at least the first fabric grasper is movably engaged within the enclosure.

12. The fabric treating system of claim 9, further comprising:

a hanger including a collar having an aperture defined therein;

a first arm extending from the collar in a first direction; and a second arm extending from the collar in a second direction, wherein the first and second arms are configured to support the piece of fabric.

13. The fabric treating system of claim 12, further comprising:

a first hanging member movably engaged with the aperture in the collar; and a second, separate hanging member extending from the collar and configured to engage the support member.

14. The fabric treating system of claim 9, wherein a portion of the piece of fabric wraps around the tensioning beam.

* * * * *